US010527966B2

(12) United States Patent
Sato

(10) Patent No.: US 10,527,966 B2
(45) **Date of Patent: *Jan. 7, 2020**

(54) IMAGE FORMING APPARATUS PROVIDING CONSTANT TONER LEVEL IN DEVELOPING UNIT

(71) Applicant: Brother Kogyo Kabushiki Kaisha, Nagoya-shi, Aichi-ken (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/199,595

(22) Filed: Nov. 26, 2018

(65) Prior Publication Data

US 2019/0094757 A1 Mar. 28, 2019

Related U.S. Application Data

(63) Continuation of application No. 15/648,662, filed on Jul. 13, 2017, now Pat. No. 10,168,640.

(30) Foreign Application Priority Data

Sep. 30, 2016 (JP) ..... 2016-194525

(51) Int. Cl.
*G03G 15/08* (2006.01)

(52) U.S. Cl.
CPC ..... *G03G 15/0865* (2013.01)

(58) Field of Classification Search
None
See application file for complete search history.

(56) References Cited

U.S. PATENT DOCUMENTS 5,852,757 A * 12/1998 Tooda ..... G03G 15/0822 399/119
6,173,140 B1 * 1/2001 Suzuki ..... G03G 21/181 399/110

(Continued)

FOREIGN PATENT DOCUMENTS

JP H5-119621 A 5/1993
JP 2006-308740 A 11/2006

(Continued)

OTHER PUBLICATIONS

JP_2006308740_A_T MachineTranslation, Japan, Nov. 2006, Tanaka (Year: 2006).*

*Primary Examiner* — Victor Verbitsky
(74) *Attorney, Agent, or Firm* — Banner & Witcoff, Ltd.

(57) ABSTRACT

An image forming apparatus has a toner cartridge to accommodate toner, a developing unit comprising a developing roller, and a drum unit. The developing unit has a toner supply member supplying the toner to the developing roller, and a frame. The toner supply member has a shaft, and flexible sheets provided at the shaft. The frame has a first chamber accommodating the developing roller, a second chamber next to the first second chamber for accommodating the toner supply member, an inlet opening for introducing the toner from the toner cartridge to the second chamber, and an adjustment member positioned between the first chamber and the second chamber. The adjustment member allows the toner to move from the second chamber to the first chamber when the sheets move from a lower edge to an upper edge of the adjustment member with contacting the adjustment member by rotating the shaft.

15 Claims, 18 Drawing Sheets

(56) References Cited

U.S. PATENT DOCUMENTS

| | | | | |
|---|---|---|---|---|
| 8,577,263 | B2 | 11/2013 | Mase | |
| 2010/0166458 | A1 | 7/2010 | Mase | |
| 2010/0316418 | A1* | 12/2010 | Sato | G03G 15/0808 399/281 |

FOREIGN PATENT DOCUMENTS

| | | | | |
|---|---|---|---|---|
| JP | 2006308740 | A | * | 11/2006 |
| JP | 2010-156759 | A | | 7/2010 |
| JP | 2010-286725 | A | | 12/2010 |
| JP | 2014-092613 | A | | 5/2014 |

* cited by examiner

IMAGE FORMING APPARATUS PROVIDING CONSTANT TONER LEVEL IN DEVELOPING UNIT

CROSS REFERENCE TO RELATED APPLICATION

This application is a continuation of U.S. patent application Ser. No. 15/648,662 filed Jul. 13, 2017, which claims priority from Japanese Patent Application No. 2016-194525 filed Sep. 30, 2016. The entire content of the priority applications are incorporated herein by reference.

TECHNICAL FIELD

The present disclosure relates to an image forming apparatus.

BACKGROUND

There is conventionally known an image forming apparatus including a drum unit, a developing unit, and a toner cartridge. The drum unit includes a photosensitive drum, and the developing unit includes a developing roller. The toner cartridge accommodates therein toner to be supplied to the developing unit.

Prior art discloses an image forming apparatus including a developing unit, and a toner cartridge. The developing unit includes a frame for supporting a developing roller. The frame has an inlet opening through which toner in the toner cartridge can be introduced into the frame. The toner cartridge is attachable to and detachable from the developing unit, and includes a toner supply member. The toner supply member is configured to supply toner into the developing unit through the inlet opening in a state where the toner cartridge is attached to the developing unit.

SUMMARY

In the conventional image forming apparatus disclosed in prior art, adjustment for making the level of the toner in the frame constant is needed in order to stably supply toner to the developing roller. However, according to the disclosed device, the toner may be moved between the frame and the toner cartridge through the inlet opening in the attached state of the toner cartridge to the developing unit. Therefore, adjustment for making the toner level in the frame constant would be difficult.

In view of the foregoing, it is an object of the disclosure to provide an image forming apparatus capable of adjusting a level of the toner to be constant within a first chamber.

In order to attain the above and other objects, the disclosure provides an image forming apparatus having a main body; a toner cartridge attachable to and detachable from the main body, the toner cartridge being configured to accommodate therein toner; and a process unit attachable to and detachable from the main body, the process unit comprising: a drum unit comprising a photosensitive drum; and a developing unit comprising a developing roller, the developing unit being movable relative to the drum unit, the developing unit having; a toner supply member configured to supply the toner to the developing roller, the toner supply member comprising a shaft rotatable, and a flexible sheet provided at the shaft; and a frame supporting the developing roller and the toner supply member; the frame having: a first chamber accommodating therein the developing roller; a second chamber accommodating therein the toner supply member, the second chamber and the first chamber being arrayed in a horizontal direction in a state where the process unit is attached to the main body; an inlet opening through which the toner is introduced from the toner cartridge to the second chamber in a state where the toner cartridge and the process unit are attached to the main body; and an adjustment member positioned between the first chamber and the second chamber, the adjustment member being configured to adjust movement of the toner between the first chamber and the second chamber, the adjustment member having an upper edge and a lower edge in the attached state of the process unit to the main body, the flexible sheet moving from the lower edge toward the upper edge while being in contact with the adjustment member by rotating the shaft, and the adjustment member allowing the toner to move from the second chamber to the first chamber in a case where the flexible sheet moves from the lower edge toward the upper edge.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

An image forming apparatus 1 according to one embodiment will be described with reference to FIGS. 1 through 15.

1. Outline of Image Forming Apparatus

Figure 1:
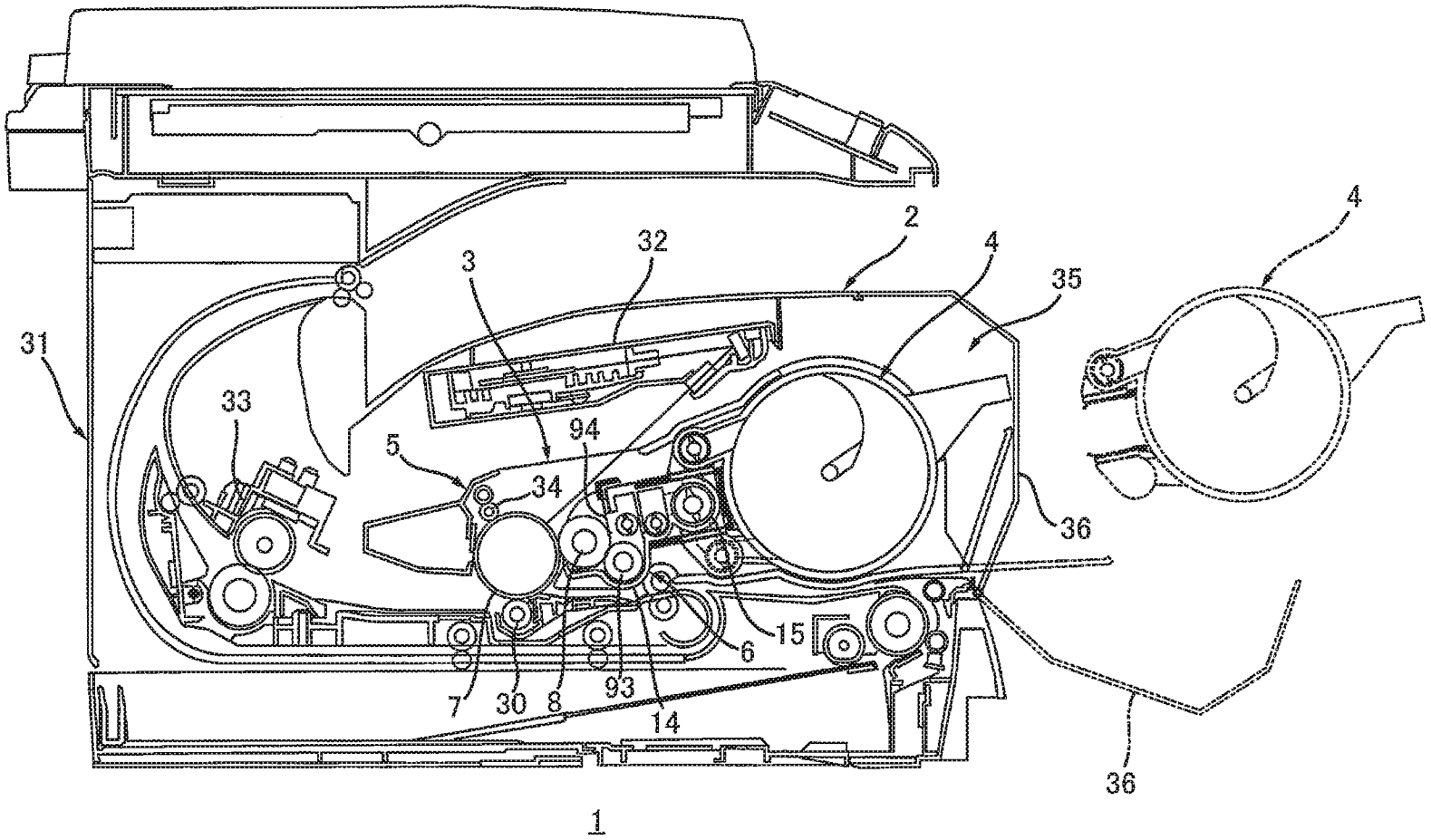
FIG. 1 is a cross-sectional view of an image forming apparatus according to one embodiment.
Figure 2:
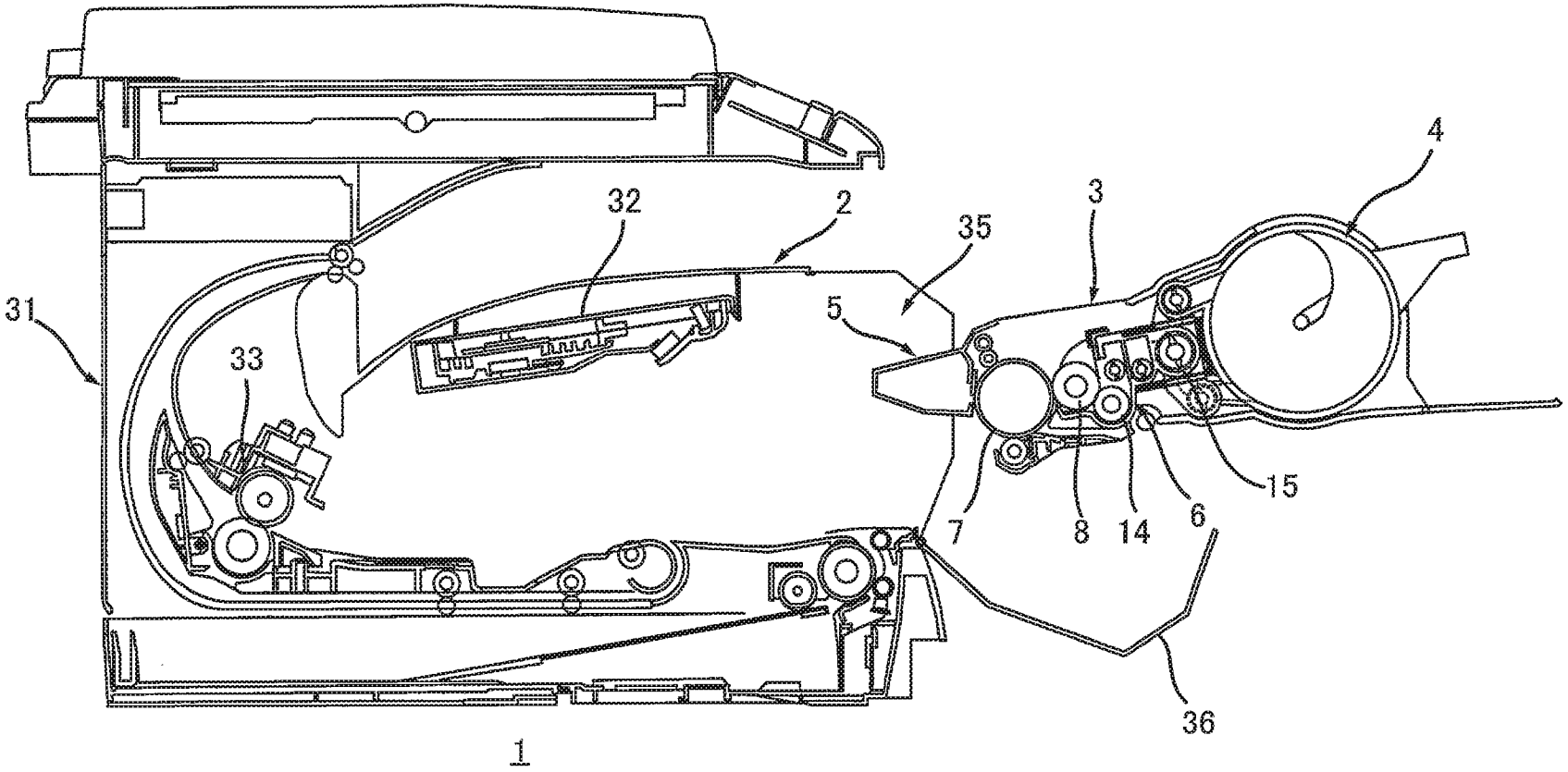
FIG. 2 is a view for description of attachment and remove of a process unit in the image forming apparatus illustrated in FIG. 1.

As illustrated in FIGS. 1 and 2, the image forming apparatus 1 includes a main body 2, a process unit 3, and a toner cartridge 4. The toner cartridge 4 is configured to accommodate therein toner, which is, for example, a non-magnetic single component type toner. The process unit 3 is configured to form a toner image on a sheet using the toner supplied from the toner cartridge 4. The process unit 3 includes a photosensitive drum 7.

1.1 Main Body

The main body 2 includes a main casing 31, an exposure device 32, and a fixing device 33.

The main casing 31 constitutes an outer shell of the image forming apparatus 1, and has an opening 35. The main casing 31 includes a front cover 36. The opening 35 is opened or closed by the front cover 36. The front cover 36 is movable between a closed position (FIG. 1) closing the opening 35 and an open position (FIG. 2) opening the opening 35. The process unit 3, the toner cartridge 4, the exposure device 32, and the fixing device 33 are accommodated in the main casing 31.

The exposure device 32 is configured to expose a surface of the photosensitive drum 7 to light. The exposure device 32 is positioned above the process unit 3.

The fixing device 33 is configured to apply heat and pressure to the sheet on which the toner image has been transferred form the process unit 3 so as to thermally fix the toner image onto the sheet. The fixing device 33 is positioned beside the process unit 3 in a horizontal direction.

1.2 Process Unit

The process unit 3 includes a drum unit 5 and a developing unit 6. The drum unit 5 includes the photosensitive drum 7, a charge roller 34, and a transfer roller 30. The charge roller 34 is configured to charge the surface of the photosensitive drum 7, and is in contact with the photosensitive drum 7. The photosensitive drum 7 is rotatable about a rotation axis extending in a predetermined direction. The surface of the photosensitive drum 7 that has been charged is subjected to exposure to light by the exposure device 32 to form an electrostatic latent image on the surface of the photosensitive drum 7. The transfer roller 30 is configured to transfer the toner image on the photosensitive drum 7 to the sheet. The transfer roller 30 is in contact with the photosensitive drum 7.

The developing unit 6 is configured to supply the toner to the surface of the photosensitive drum 7 to develop the electrostatic latent image on the surface of the photosensitive drum 7 into a toner image on the surface of the photosensitive drum 7. The developing unit 6 includes a developing roller 8, a supply roller 93, and a layer thickness regulation blade 94. The developing roller 8 is rotatable about a rotation axis extending in the predetermined direction. Here, an extending direction of the rotation axis of the developing roller 8 will be referred to as "an axial direction". The developing roller 8 is in contact with the photosensitive drum 7. The supply roller 93 is configured to supply toner to the developing roller 8. The supply roller 93 is rotatable about a rotation axis extending in the axial direction. The supply roller 93 is in contact with the developing roller 8. The layer thickness regulation blade 94 is configured to regulate a thickness of a toner layer supplied to the developing roller 8. The blade 94 is in contact with the developing roller 8.

The process unit 3 can be detached from and attached to the main body 2 through the opening 35. The drum unit 5 is fixed to the main body 2 in a state where the process unit 3 is attached to the main body 2.

1.3 Toner Cartridge

The toner cartridge 4 is configured to supply toner to the developing unit 6. The toner cartridge 4 can be detached from and attached to the main body 2 through the opening 35. Specifically, the toner cartridge 4 can solely be attached to and detached from the main body 2 (FIG. 1). Further, the toner cartridge 4 can be attached to and detached from the main body 2, while being attached to the process unit 3 (FIG. 2). The toner cartridge 4 is positioned opposite to the photosensitive drum 7 with respect to the developing unit 6 in a state where the toner cartridge 4 and the process unit 3 are attached to the main body 2.

2. Details of Process Unit

Figure 4:
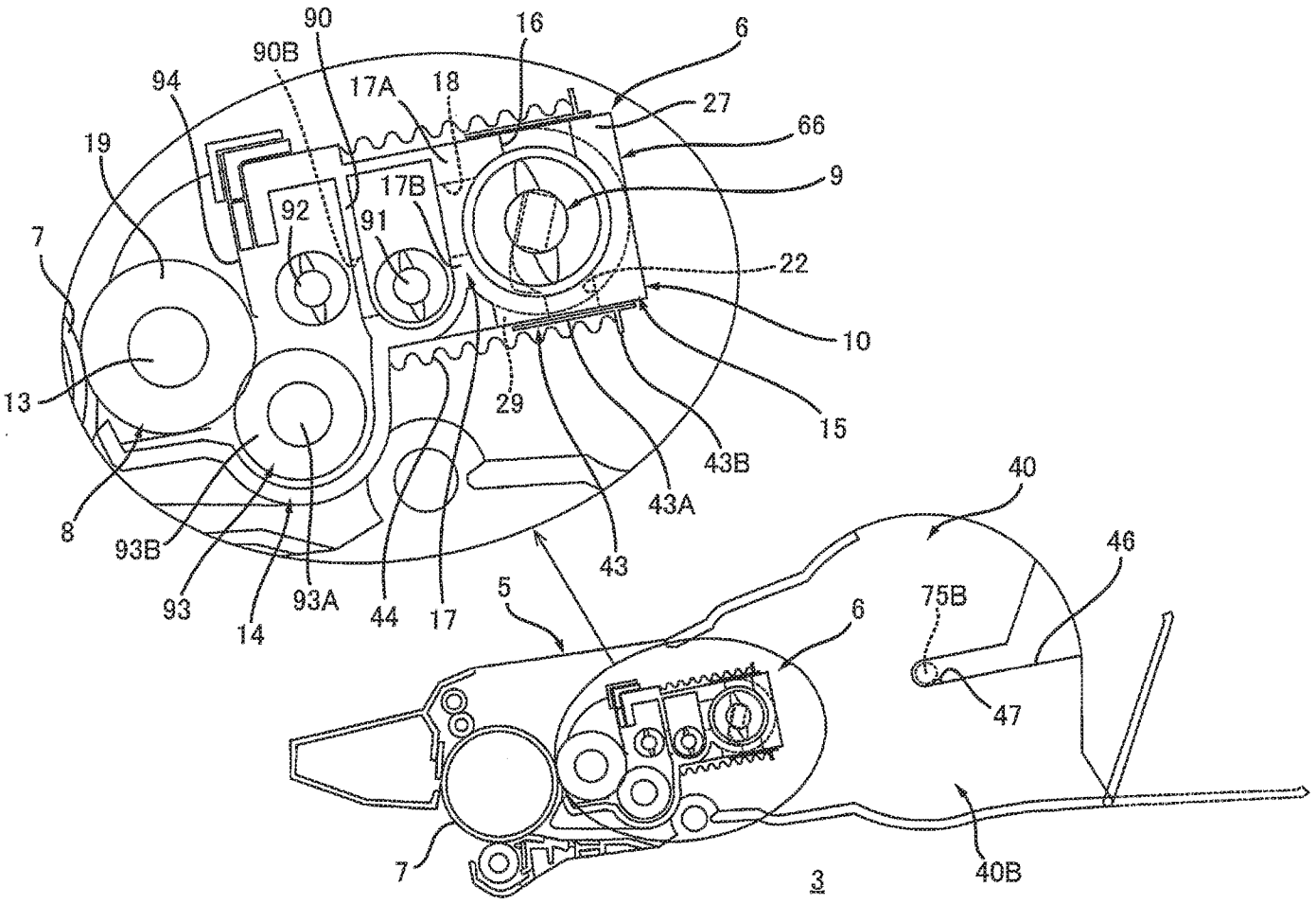
FIG. 4 is a cross-sectional view of the process unit taken along a line A-A in FIG. 3.

The process unit 3 is configured to regulate a level of the toner in a first chamber 14 of the developing unit 6. As illustrated in FIG. 4, the developing unit 6 includes the first chamber 14, a second chamber 15, and an adjustment member 17. The first chamber 14 accommodates therein the developing roller 8. The second chamber 15 is configured to receive toner supplied from the toner cartridge 4. The adjustment member 17 is configured to control movement of the toner between the first chamber 14 and the second chamber 15. The adjustment member 17 is positioned between the first chamber 14 and the second chamber 15. The adjustment member 17 partitions an internal space of the first chamber 14 from an internal space of the second chamber 15.

2.1 Details of Developing Unit

Details of the developing unit 6 will be described with reference to FIGS. 3 through 7.

Figure 3:
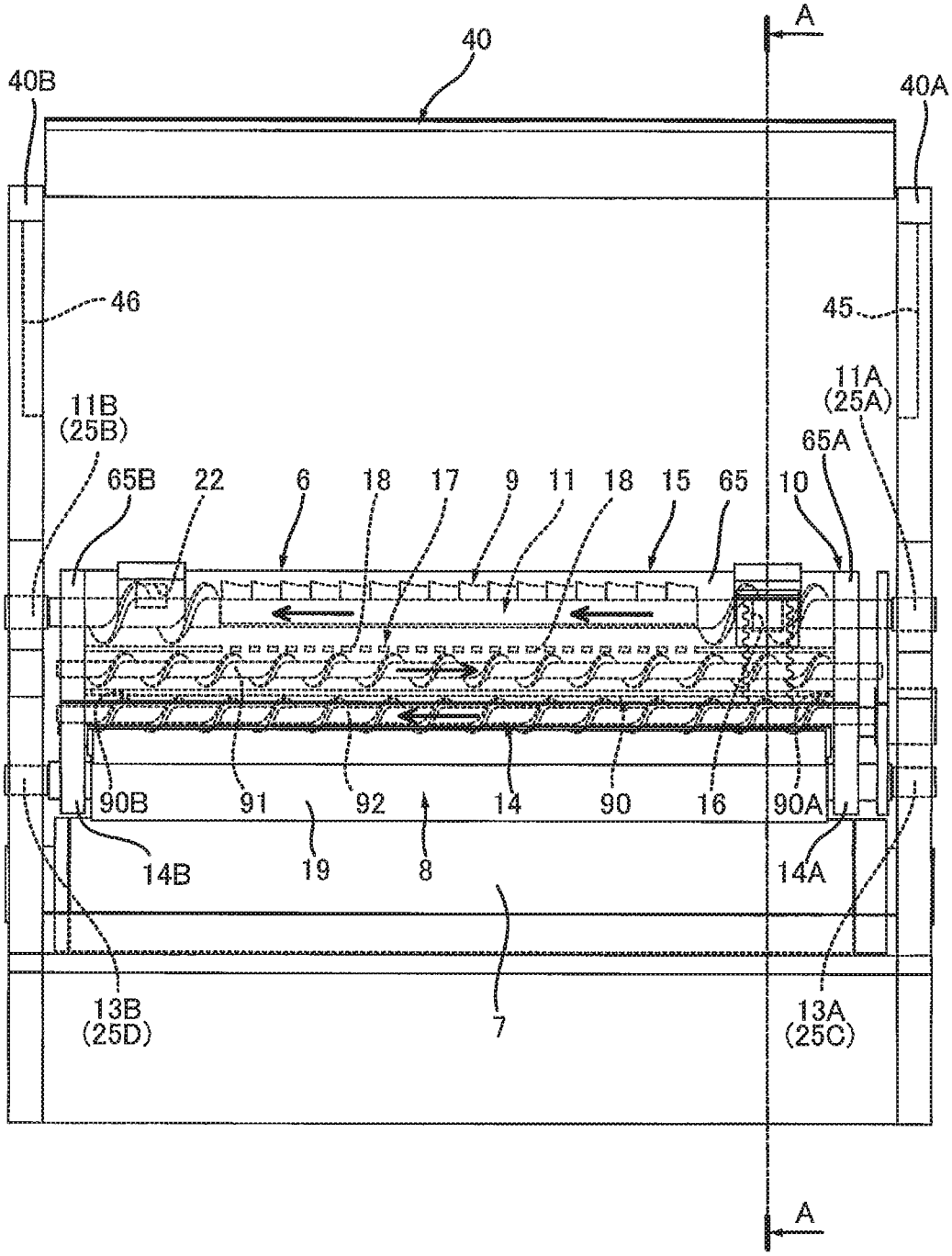
FIG. 3 is a plan view of the process unit illustrated in FIG. 1.

As illustrated in FIGS. 3 and 4, the developing unit 6 further includes a frame 10 and a toner supply member 9. The frame 10 integrally provides the first chamber 14, the second chamber 15, and the adjustment member 17.

2.1.1 First Chamber

The first chamber 14 accommodates therein toner to be supplied to the developing roller 8. The developing roller 8 includes a developing roller shaft 13 extending in the axial direction, and a roller portion 19 disposed around the developing roller shaft 13. The first chamber 14 rotatably supports the developing roller 8, and accommodates therein the roller portion 19.

As illustrated in FIG. 4, the first chamber 14 also accommodates therein the supply roller 93 and the layer thickness regulation blade 94. The supply roller 93 includes a supply roller shaft 93A extending in the axial direction, and a roller portion 93B disposed around the supply roller shaft 93A. The first chamber 14 rotatably supports the supply roller 93, and accommodates therein the roller portion 93B. The roller portion 93B is in contact with the roller portion 19 of the developing roller 8. The roller portions 93B and 19 provide a nip region therebetween at which the toner is charged.

The layer thickness regulation blade 94 extends in the axial direction. The blade 94 includes a base end portion and a free end portion in a direction crossing the axial direction. The base end portion is fixed to the first chamber 14, and the free end portion is in contact with a peripheral surface of the roller portion 19 of the developing roller 8. The blade 94 is configured to regulate the thickness of the toner layer on the roller portion 19 and to charge the toner at a nip region between the blade 94 and the roller portion 19.

As illustrated in FIG. 3, the first chamber 14 is configured to circulate the toner accommodated therein. The first chamber 14 further includes a partition wall 90, a first auger 91, and a second auger 92.

The partition wall 90 partitions the internal space of the first chamber 14 into two spaces. The partition wall 90 is positioned between the adjustment member 17 and the developing roller 8. The partition wall 90 is positioned spaced away from the adjustment member 17, and has a first opening 90A (FIG. 3) and a second opening 90B (FIG. 3). The first opening 90A and the second opening 90B are positioned at one end portion and the other end portion in the axial direction of the partition wall 90, respectively.

The first auger 91 includes one end portion and the other end portion in the axial direction, and the one end portion is close to the first opening 90A, and the other end portion is close to the second opening 90B. The first auger 91 is configured to convey toner between the adjustment member 17 and the partition wall 90 from the other end portion to the one end portion of the first auger 91. In other words, the first auger 91 is configured to convey toner between the adjustment member 17 and the partition wall 90 from the second opening 90B to the first opening 90A. The first auger 91 is positioned between the adjustment member 17 and the partition wall 90 in the first chamber 14. The first auger 91 extends in the axial direction and is rotatable.

The second auger 92 is configured to convey toner between the partition wall 90 and the developing roller 8 from the one end portion to the other end portion of the first auger 91. In other words, the second auger 92 is configured to convey toner at the position between the partition wall 90 and the developing roller 8 from the first opening 90A to the second opening 90B. The second auger 92 is positioned between the partition wall 90 and the developing roller 8 in the first chamber 14. The second auger 92 extends in the axial direction and is rotatable.

Toner accommodated in the first chamber 14 is circulated through the first opening 90A and the second opening 90B by the rotation of the first auger 91 and the second auger 92. Therefore, a uniform level or height of toner in the first chamber 14 can be maintained in the axial direction.

2.1.2 Second Chamber

The second chamber 15 is configured to accommodate toner supplied from the toner cartridge 4 therein. The toner accommodated in the second chamber 15 is conveyed from the second chamber 15 to the first chamber 14 by the toner supply member 9. The second chamber 15 is juxtaposed to the first chamber 14 in the horizontal direction (FIG. 1) in a state where the process unit 3 is attached to the main body 2. Incidentally, a direction of an array of the first chamber 14 and the second chamber 15 will be referred to as "an array direction" crossing the vertical direction and the axial direction. Specifically, the array direction is perpendicular to the axial direction of the developing roller 8, and crosses the vertical direction. The second chamber 15 is positioned opposite to the photosensitive drum 7 with respect to the first chamber 14 in the state where the process unit 3 is attached to the main body 2.

Figure 5:
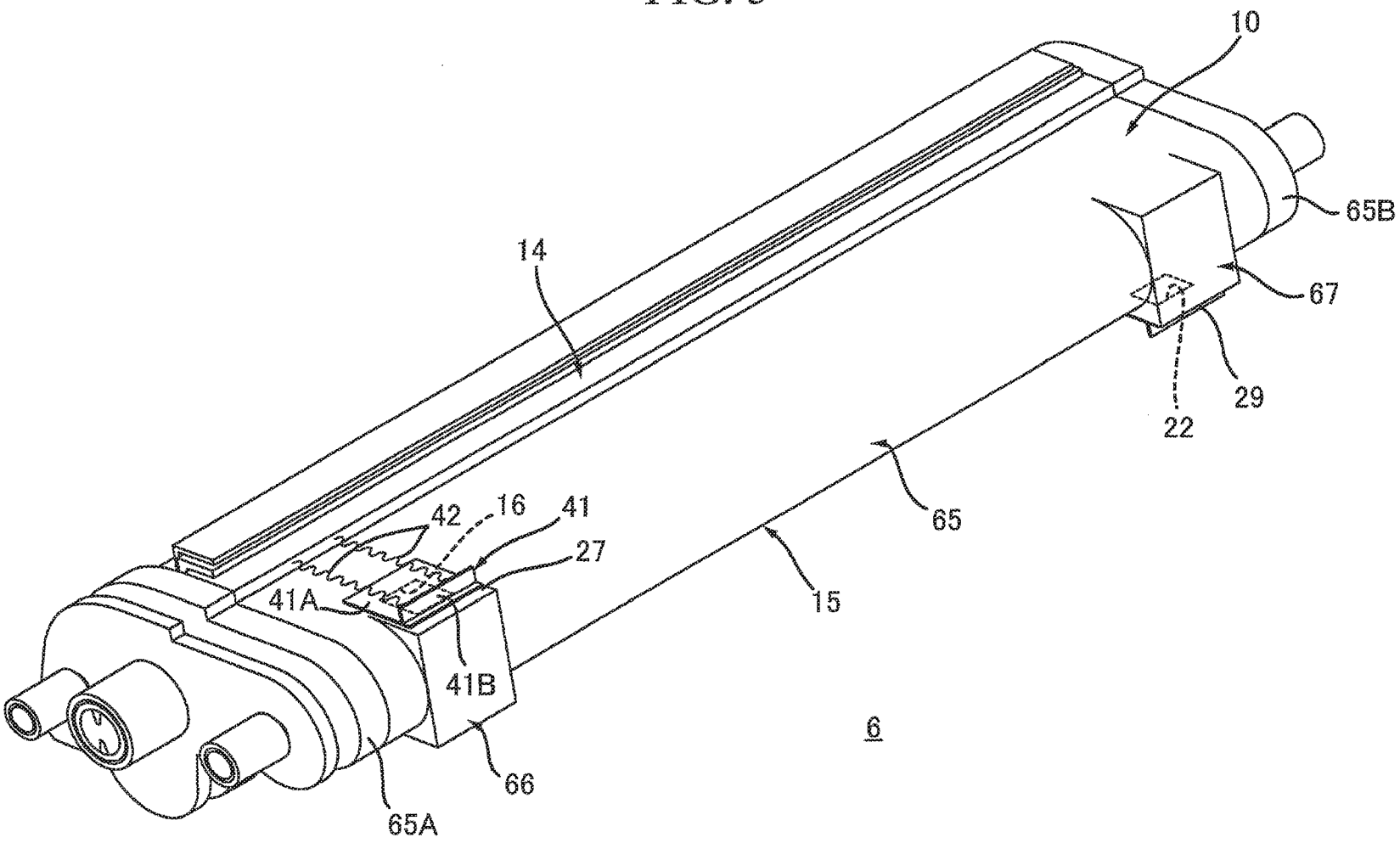
FIG. 5 is perspective view of a developing unit in the process unit illustrated in FIG. 4.

As illustrated in FIGS. 4 and 5, the frame 10 is configured to receive toner supplied from the toner cartridge 4. The frame 10 has an inlet opening 16. The inlet opening 16 allows the toner to be introduced into the second chamber 15 from the toner cartridge 4 in the attached state of the toner cartridge 4 and the process unit 3 to the main body 2. The inlet opening 16 is positioned above the toner supply member 9 in the attached state of the process unit 3 to the main body 2. Specifically, the second chamber 15 has the inlet opening 16 communicating with an internal space of the second chamber 15.

The second chamber 15 has a chamber body 65, and a receiving portion 66. The chamber body 65 defines an internal space in which the toner is accommodatable. The chamber body 65 extends in the axial direction, and includes a first side wall 65A and a second side wall 65B spaced away from the first side wall 65A in the axial direction.

The receiving portion 66 has the inlet opening 16. The receiving portion 66 is positioned opposite to the first chamber 14 with respect to the chamber body 65. The receiving portion 66 includes a wall 27 having the inlet opening 16. The wall 27 has the inlet opening 16. In other words, the frame 10 includes the wall 27 having the inlet opening 16.

The wall 27 is positioned at an upper end portion of the receiving portion 66 in the attached state of the process unit 3 to the main body 2. The wall 27 extends in the array direction. Further, the wall 27 extends in a sliding direction of the developing unit 6. The sliding direction will be described later.

As illustrated in FIG. 5, the developing unit 6 further includes a first developing shutter 41 and a spring 42. The first developing shutter 41 is configured to open and close the inlet opening 16, and faces the wall 27. The first developing shutter 41 is movable between a closed position (FIG. 5) closing the inlet opening 16 and an open position (FIG. 11) opening the inlet opening 16. The spring 42 is configured to bias the first developing shutter 41 to the closed position. Thus, the first developing shutter 41 is positioned at the closed position in the detached state of the toner cartridge 4 from the main body 2.

Specifically, the first developing shutter 41 is movable between the open position and the closed position in the array direction. The first developing shutter 41 includes a base portion 41A and a protruding portion 41B. The base portion 41A covers the inlet opening 16 in the closed position of the first developing shutter 41. The base portion 41A has a plate shape and extends along the wall 27.

Figure 11:
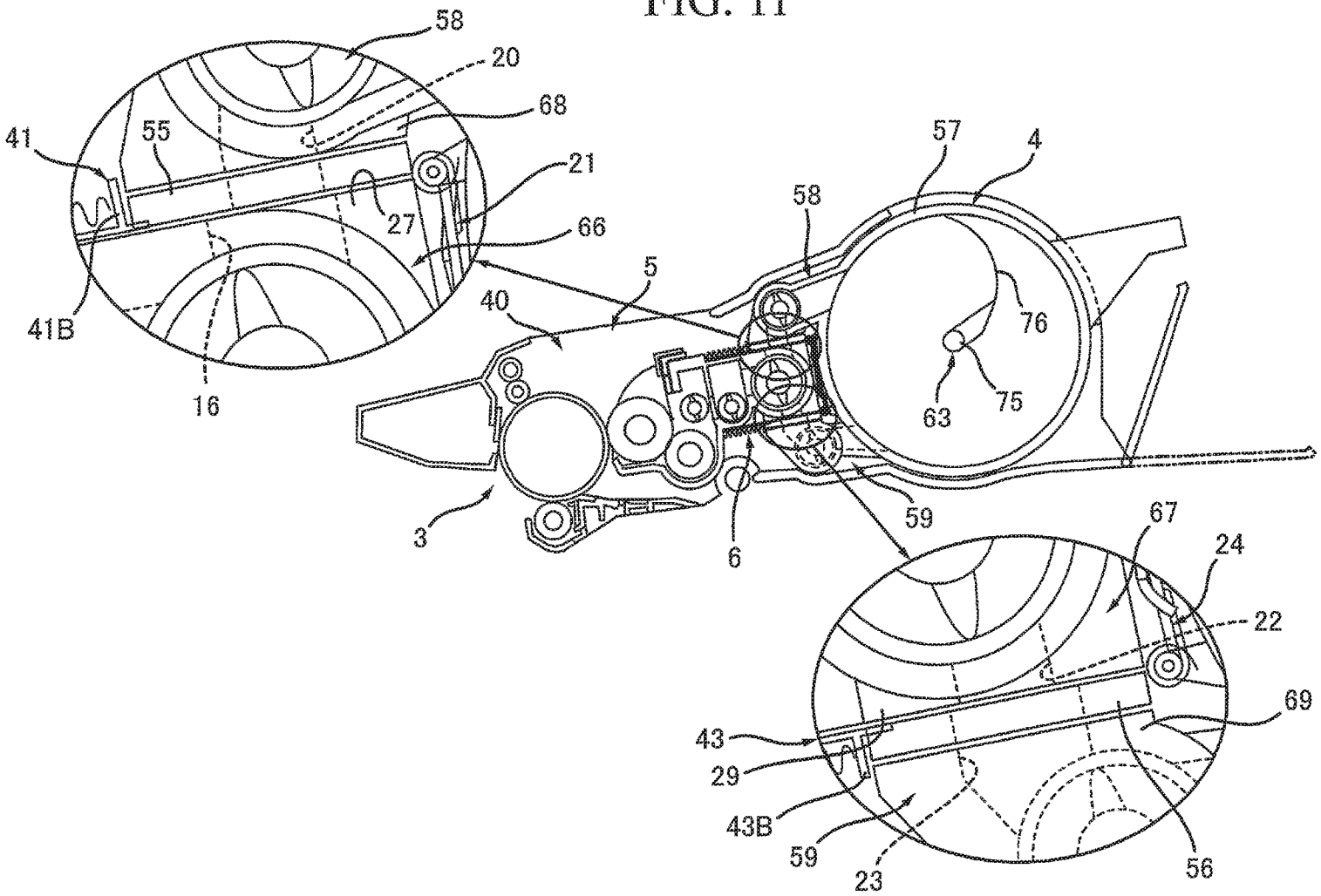
FIG. 11 is a view for description of attached state of the toner cartridge to the process unit illustrated in FIG. 4.

The protruding portion 41B is configured to contact a supply portion 58 (FIG. 11) in the attached state of the toner cartridge 4 to the main body 2. The protruding portion 41B is positioned opposite to the wall 27 with respect to the base portion 41A. The protruding portion 41B protrudes from the base portion 41A. As illustrated in FIG. 11, the first developing shutter 41 is moved from the closed position to the open position by the abutment of the protruding portion 41B against the supply portion 58 during attachment of the toner cartridge 4 to the main body 2. Thus, the first developing shutter 41 is at the open position upon attachment of the toner cartridge 4 to the main body 2.

Figure 8:
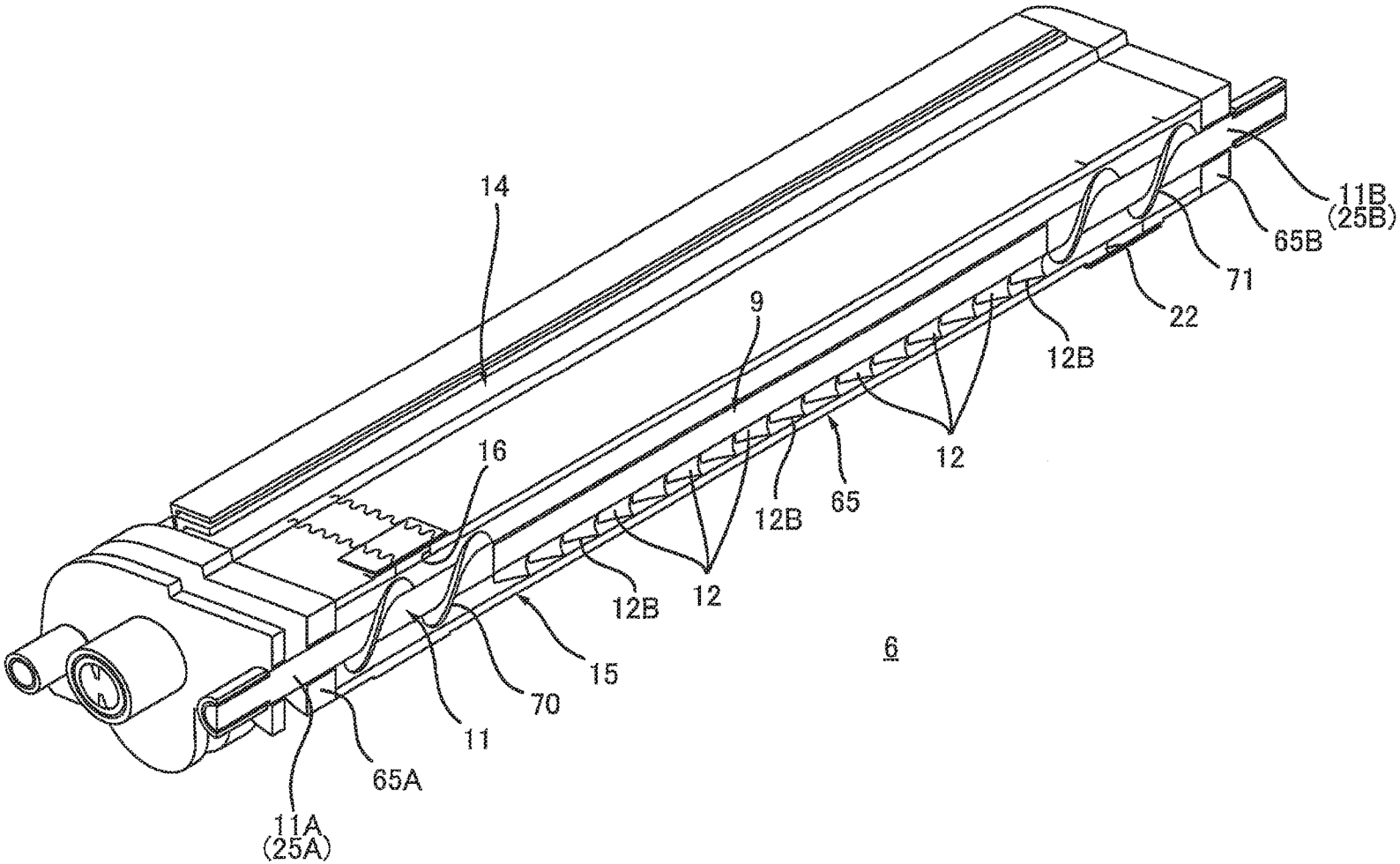
FIG. 8 is a perspective view of the developing unit cut along a plane passing through the shaft, and particularly illustrating a toner supply member illustrated in FIG. 4.
Figure 9:
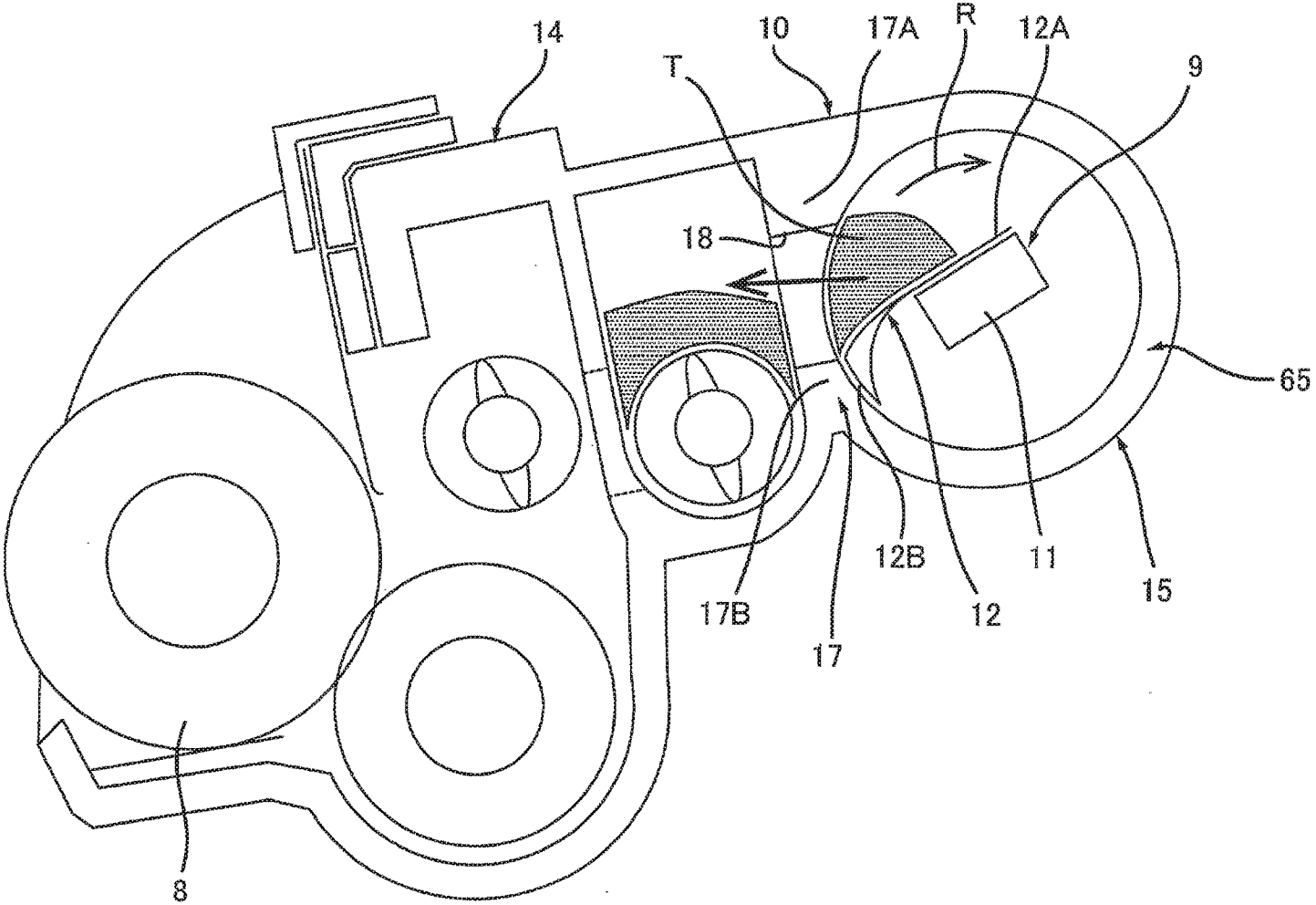
FIG. 9 is a view for description of toner moving from the second chamber illustrated in FIG. 8 to a first chamber.

The second chamber 15 accommodates therein the toner supply member 9. As illustrated in FIGS. 8 and 9, the toner supply member 9 is configured to supply toner to the developing roller 8. Specifically, the toner supply member 9 is positioned opposite to the first chamber 14 with respect to the adjustment member 17. The toner supply member 9 is configured to supply toner from the second chamber 15 to the first chamber 14 through the adjustment member 17. The toner supply member 9 is accommodated in the chamber body 65 and is rotatably supported by the chamber body 65. That is, the frame 10 supports the developing roller 8 and the toner supply member 9.

As illustrated in FIG. 8, the toner supply member 9 includes a shaft 11 and a plurality of flexible sheets 12. The shaft 11 extends in the axial direction, and has one end portion 11A and the other end portion 11B in the axial direction. The one end portion 11A of the shaft 11 is rotatably supported to the first side wall 65A, and the other end portion 11B of the shaft 11 is rotatably supported to the second side wall 65B. Thus, the shaft 11 is rotatably supported to the chamber body 65.

As illustrated in FIG. 9, the flexible sheets 12 are films having flexibility. In this embodiment, the flexible sheets 12 are provided at the shaft 11 and are rotatable along with the shaft 11 by the rotation of the shaft 11. Each flexible sheet 12 has a base end portion 12A fixed to the shaft 11 and a free end portion 12B opposite to the base end portion 12A and remote from the shaft 11. The free end portion 12B is in sliding contact with an inner surface of the chamber body 65 and the adjustment member 17 during rotation of the shaft 11. Thus, the flexible sheets 12 are flexed.

The toner supply member 9 is configured to convey the toner supplied from the inlet opening 16 in the axial direction as illustrated in FIGS. 3 and 8. That is, the toner supply member 9 is configured to covey toner from one end to the other end of the toner supply member 9 in the axial direction.

The toner supply member 9 further includes a first screw 70 and a second screw 71 (FIG. 8).

The first screw 70 is provided at the shaft 11, and is positioned below the inlet opening 16 in the attached state of the process unit 3 to the main body 2. The first screw 70 helically extends over a peripheral surface of the shaft 11.

The second screw 71 is provided at the shaft 11, and is distant from the first screw 70 in the axial direction. The second screw 71 is positioned above a discharge opening 22 (described later) in the attached state of the process unit 3 to the main body 2. The second screw 71 helically extends over the peripheral surface of the shaft 11.

The plurality of flexible sheets 12 are positioned between the first screw 70 and the second screw 71 on the shaft 11. The plurality of flexible sheets 12 are arrayed in the axial direction. Each flexible sheet 12 includes a first edge and a second edge those arrayed in the axial direction. The first edge is positioned closer to the inlet opening 16 than the second edge is to the inlet opening 16. The second edge has a length greater than that of the first edge. That is, each distal end of each free end portion 12B is inclined outward in a radial direction of the shaft 11 in a direction from one end portion to the other end portion of the shaft 11.

With this structure, the second edge of each flexible sheet 12 moves belatedly in comparison with the movement of the first edge when each free end portion 12B of the flexible sheet 12 is to be moved in sliding contact with the adjustment member 17. Accordingly, toner in the second chamber 15 can be conveyed in the axial direction. Thus, the toner in the second chamber 15 is conveyed from one end portion to the other end portion of the toner supply member 9 by the rotation of the shaft 11.

2.1.3 Adjustment Member

Figure 14:
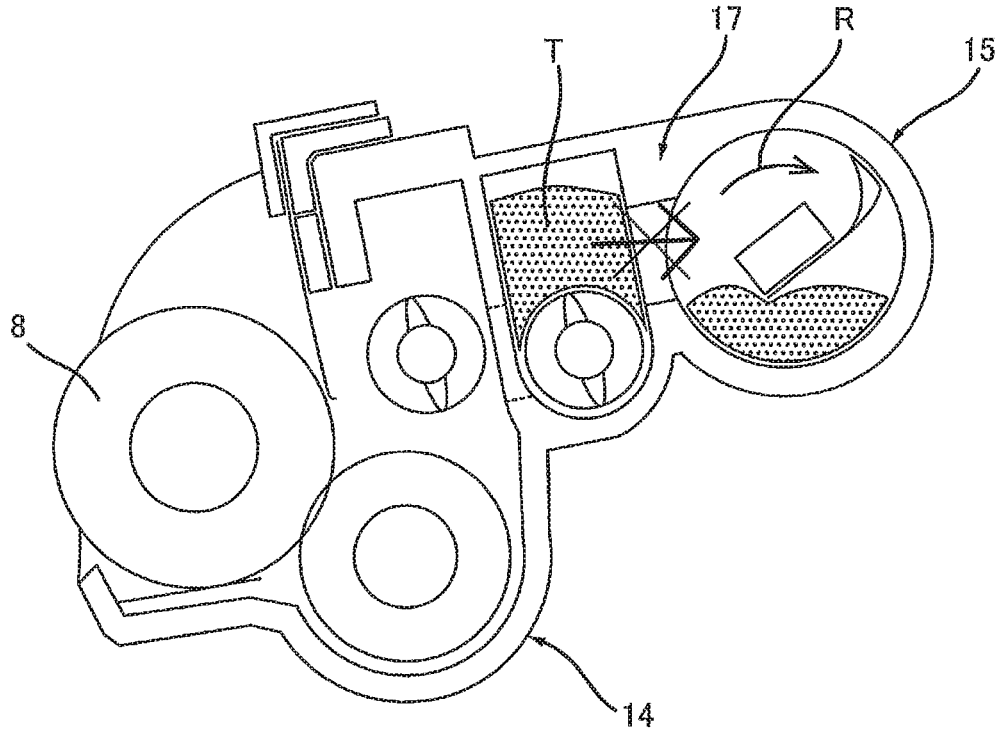
FIG. 14 is a view for description of non-return of the toner from the first chamber illustrated in FIG. 9 to the second chamber.

The adjustment member 17 is configured to adjust movement of the toner between the first chamber 14 and the second chamber 15. Specifically, as illustrated in FIG. 9, the adjustment member 17 allows the toner to move from the second chamber 15 to the first chamber 14 in a state where the toner level in the first chamber 14 is lower than a predetermined level. Further, as illustrated in FIG. 14, the adjustment member 17 restrains the toner from returning from the first chamber 14 to the second chamber 15.

Figure 6:
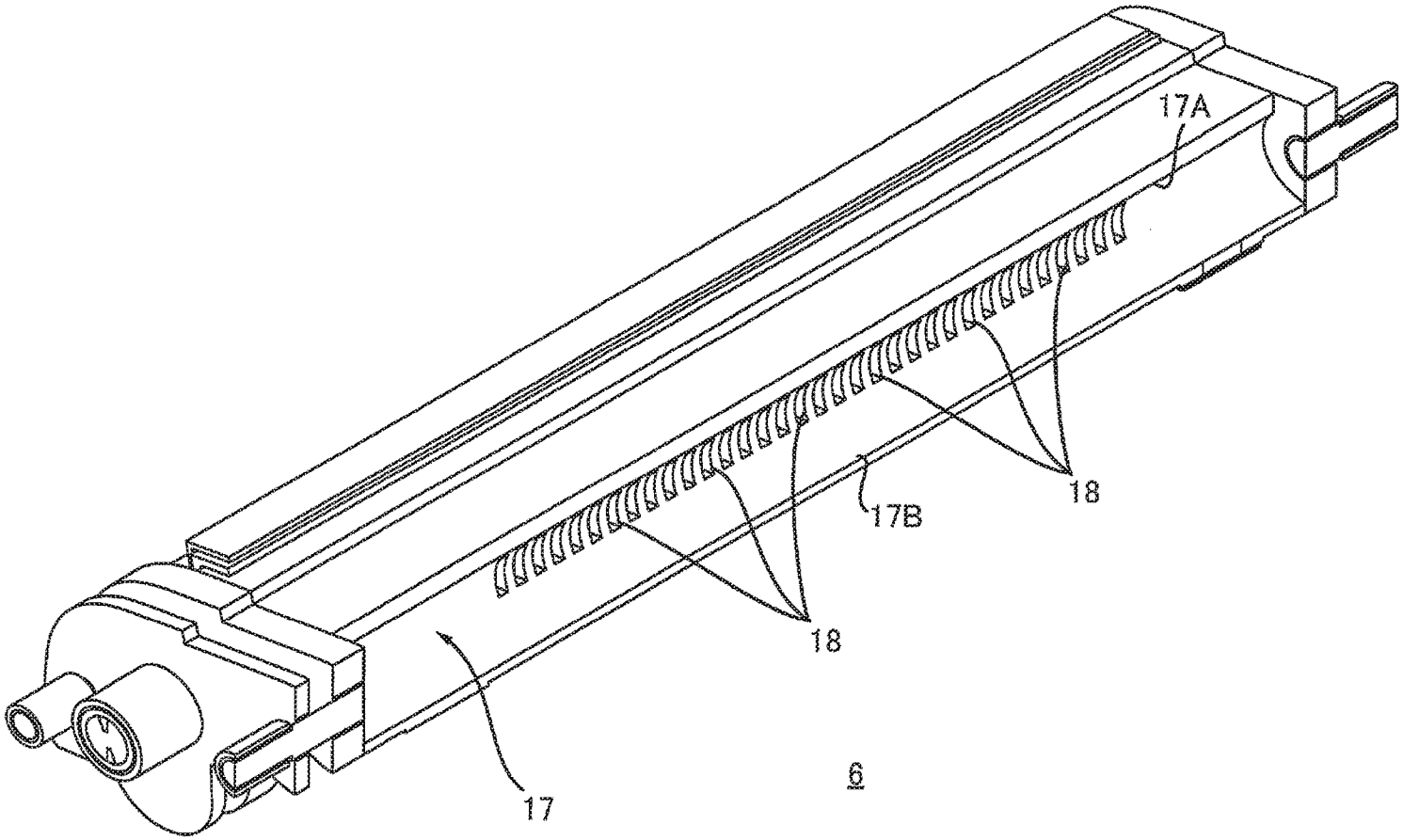
FIG. 6 is a perspective view, omitting a shaft, of the developing unit cut along a plane passing through a second chamber, and particularly illustrating an adjustment member illustrated in FIG. 4.

As illustrated in FIGS. 4 and 6, the adjustment member 17 includes an upper edge 17A and a lower edge 17B in the attached state of the process unit 3 to the main body 2. Specifically, the adjustment member 17 extends in a direction crossing the array direction. The adjustment member 17 includes one end and the other end in the direction crossing the array direction. The one end of the adjustment member 17 is positioned above the other end thereof in the attached state of the process unit 3 to the main body 2. That is, the one end of the adjustment member 17 is the upper edge 17A, and the other end of the adjustment member 17 is the lower edge 17B. The upper edge 17A is connected to the upper wall of the frame 10, and the lower edge 17B is connected to the bottom wall of the frame 10.

The adjustment member 17 includes a plurality of slits 18 allowing communication between the first chamber 14 and the second chamber 15. In other words, the internal space of the first chamber 14 is communicated with the internal space of the second chamber 15 through the slits 18. The slits 18 are through-holes.

Figure 7:
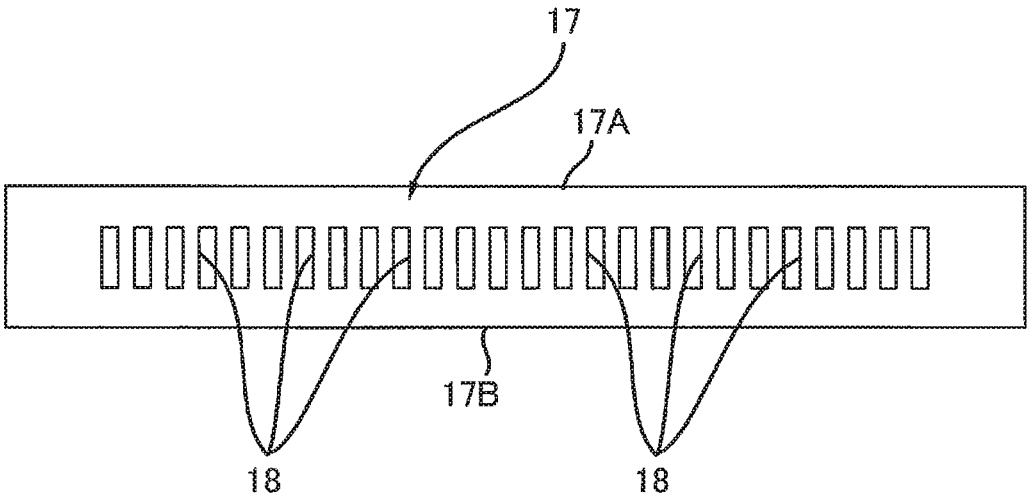
FIG. 7 is a front view of the adjustment member illustrated in FIG. 6.

As illustrated in FIGS. 6 and 7, the slits 18 are positioned between the upper edge 17A and the lower edge 17B of the adjustment member 17, and extend in a rotational direction of the toner supply member 9 or in the vertical direction in the attached state of the process unit 3 to the main body 2. The slits 18 are arrayed in the axial direction of the developing roller 8. Thus, the toner can be uniformly supplied in the axial direction from the second chamber 15 to the first chamber 14.

Each slit 18 has a length in the vertical direction greater than a length in the axial direction. Specifically, the vertical length of the slit 18 is for example, equal to or more than 5.0 mm, and preferably equal to or more than 10.0 mm, for example, in a range of from 20.0 mm to 30.0 mm. The length of the slit 18 in the axial direction is for example, equal to or more than 0.5 mm, and preferably equal to or more than 1.0 mm, for example in a range of from 3.0 mm to 5.0 mm.

Dimension of the adjustment member 17 in the array direction, i.e., the thickness of the adjustment member 17 is for example, equal to or more than 0.2 mm, and preferably, equal to or more than 1.0 mm, for example in a range of from 3.0 mm to 5.0 mm.

As illustrated in FIG. 9, the slits 18 allow toner to pass therethrough when the flexible sheets 12 move from the lower edge 17B to the upper edge 17A while the flexible sheets 12 is in sliding contact with the adjustment member 17. On the other hand, the adjustment member 17 prevents the toner from passing therethrough unless the flexible sheets 12 are in contact with the adjustment member 17.

Specifically, the free end portion 12B of the flexible sheet 12 moves in the rotational direction R from the lower edge 17B to the upper edge 17A of the adjustment member 17 with contacting the adjustment member 17 by the rotation of the shaft 11.

The adjustment member 17 allows toner to move from the second chamber 15 to the first chamber 14 when the free end portion 12B of the flexible sheet 12 is moved in the rotational direction R from the lower edge 17B to the upper edge 17A of the adjustment member 17. That is, the slits 18 allow the toner T to pass therethrough when the free end portion 12B of the flexible sheet 12 is moved in the rotational direction R from the lower edge 17B to the upper edge 17A of the adjustment member 17.

On the other hand, the slits 18 prevent the toner T from passing therethrough unless the flexible sheet 12 is in contact with the adjustment member 17. Therefore, as illustrated in FIG. 14, the adjustment member 17 prevents the toner T from moving from the first chamber 14 to the second chamber 15.

2.1.4 Discharge Opening

As illustrated in FIGS. 4 and 5, the frame 10 is configured to discharge toner from the second chamber 15. The frame 10 has the discharge opening 22. The discharge opening 22 allows the toner to be discharged from the second chamber 15 to the toner cartridge 4 in the attached state of the toner cartridge 4 and the process unit 3 to the main body 2. The discharge opening 22 is positioned below the toner supply member 9 in the attached state of the process unit 3 to the main body 2. The discharge opening 22 can discharge toner not passing through the slits 18 but remaining in the second chamber 15. With this structure, toner level in the second chamber 15 can be maintained at a constant level. Accordingly, stabilized amount of toner to be supplied from the second chamber 15 to the first chamber 14 can be realized. Consequently, toner level in the first chamber 14 can further be adjusted into the constant level.

Specifically, the second chamber 15 further has the discharge opening 22. The discharge opening 22 is communicated with the internal space of the second chamber 15. The second chamber 15 further includes a discharge portion 67. The discharge portion 67 includes the discharge opening 22. The discharge portion 67 includes a wall 29 having the discharge opening 22. The wall 29 has the discharge opening 22. In other words, the frame 10 includes the wall 29 having the discharge opening 22.

The wall 29 is positioned at a lower portion of the discharge portion 67 in the attached state of the process unit 3 to the main body 2. The wall 29 extends in the array direction. The wall 29 also extends in a sliding direction (described later) of the developing unit 6.

As illustrated in FIG. 4, the developing unit 6 further includes a second developing shutter 43 and a spring 44. The second developing shutter 43 is configured to open and close the discharge opening 22, and faces the wall 29. The second developing shutter 43 is movable between a closed position (FIG. 4) closing the discharge opening 22 and an open position (FIG. 11) opening the discharge opening 22. The spring 44 is configured to bias the second developing shutter 43 toward the closed position. Thus, the second developing shutter 43 is positioned at the closed position in the detached state of the toner cartridge 4 from the main body 2.

The second developing shutter 43 includes a base portion 43A and a protruding portion 43B. The base portion 43A covers the discharge opening 22 in the closed position of the second developing shutter 43. The base portion 43A has a plate shape and extends along the wall 29.

The protruding portion 43B is configured to contact a collecting portion 59 (FIG. 11, described later) in the attached state of the toner cartridge 4 to the main body 2. The protruding portion 43B is positioned opposite to the wall 29 with respect to the base portion 43A. The protruding portion 43B protrudes from the base portion 43A. As illustrated in FIG. 11, the second developing shutter 43 is moved from the closed position to the open position by the abutment of the protruding portion 43B against the collecting portion 59 during attachment of the toner cartridge 4 to the main body 2. Thus, the second developing shutter 43 is positioned at the open position upon attachment of the toner cartridge 4 to the main body 2.

3. Details of Toner Cartridge

Next, details of the toner cartridge 4 will be described with reference to FIGS. 4 and 10 through 13.

Figure 12:
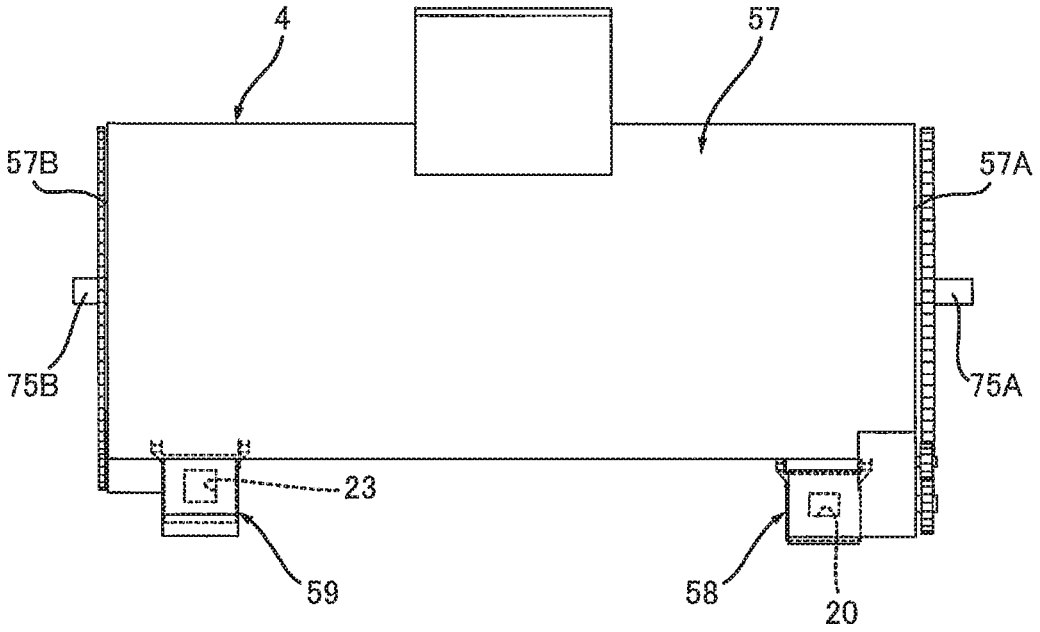
FIG. 12 is a plan view of the toner cartridge illustrated in FIG. 11.

As illustrated in FIGS. 11 and 12, the toner cartridge 4 is attachable to and detachable from the drum unit 5. The toner cartridge 4 is attached to the main body 2 through the drum unit 5 (see FIG. 1).

The toner cartridge 4 is configured to supply toner to the developing unit 6. The toner cartridge 4 has a toner supply opening 20. The toner supply opening 20 is the opening through which toner is supplied from the toner cartridge 4 to the second chamber 15 in the attached state of the toner cartridge 4 and the process unit 3 to the main body 2. The toner supply opening 20 faces the inlet opening 16 in the vertical direction in the attached state of the toner cartridge 4 and the process unit 3 to the main body 2. The toner supply opening 20 is communicated with the internal space of the toner cartridge 4. The toner supply opening 20 has a dimension in the array direction smaller than the dimension of the inlet opening 16 in the array direction.

Specifically, the toner cartridge 4 includes a hopper 57, the supply portion 58, and an agitator 63. The hopper 57 is configured to accommodate therein toner to be supplied to the developing unit 6. The hopper 57 is juxtaposed with the developing unit 6 in the array direction in the attached state of the toner cartridge 4 to the drum unit 5. The hopper 57 is positioned opposite to the photosensitive drum 7 with respect to the developing unit 6 in the attached state of the toner cartridge 4 to the drum unit 5.

The hopper 57 extends in the axial direction. The hopper 57 includes a first side wall 57A and a second side wall 57B spaced away from the first side wall 57A in the axial direction. The hopper 57 accommodates therein the agitator 63.

The agitator 63 is configured to agitate toner accommodated in the hopper 57, and to supply the toner in the hopper 57 to the supply portion 58. The agitator 63 includes an agitator shaft 75 and a blade 76. The agitator 63 is rotatable about an axis of the agitator shaft 75. The agitator shaft 75 extends in the axial direction, and having one end portion 75A and the other end portion 75B away from the one end portion 75A in the axial direction.

The blade 76 is provided at the agitator shaft 75, and is rotatable along with the agitator shaft 75. The blade 76 is in sliding contact with an inner peripheral surface of the hopper 57 by the rotation of the agitator shaft 75. By the rotation of the agitator 63, toner in the hopper 57 is conveyed to the supply portion 58 by the blade 76.

The supply portion 58 is positioned above the receiving portion 66 in the attached state of the toner cartridge 4 and the process unit 3 to the main body 2. The supply portion 58 includes a wall 68 formed with the toner supply opening 20.

The wall 68 is positioned at a lower portion of the supply portion 68 in the attached state of the toner cartridge 4 and the process unit 3 to the main body 2. The wall 68 extends in the array direction. That is, the wall 68 extends in the sliding direction of the developing unit 6. The wall 68 of the supply portion 58 faces the wall 27 of the receiving portion 66 in the vertical direction in the attached state of the toner cartridge 4 and the process unit 3 to the main body 2.

Figure 13:
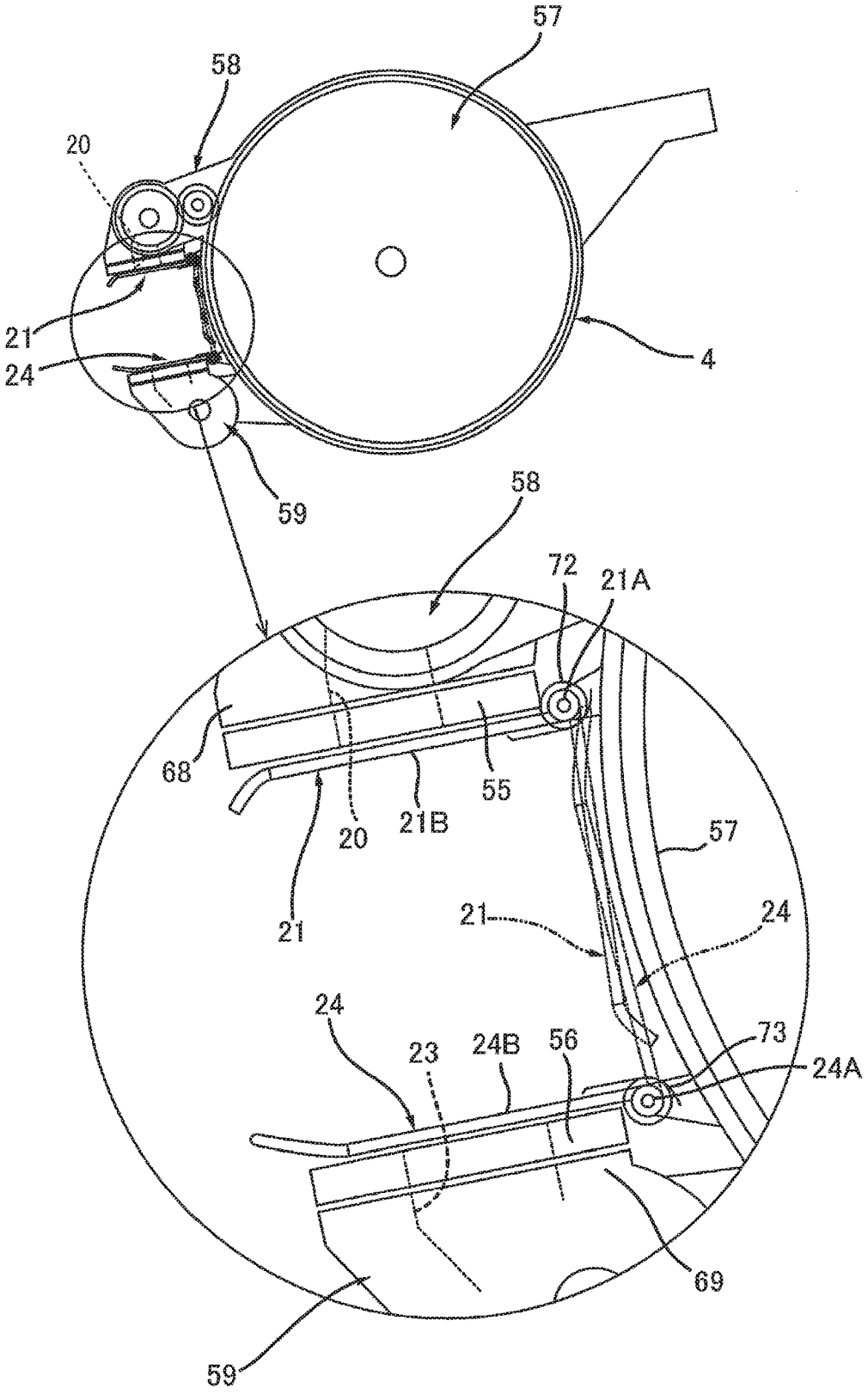
FIG. 13 is a side view of the toner cartridge illustrated in FIG. 11.

As illustrated in FIG. 13, the toner cartridge 4 further includes a first shutter 21, a spring 72, and a first seal 55.

The first shutter 21 is configured to open and close the toner supply opening 20, and is positioned at a lower portion of the supply portion 58. The first shutter 21 is moveable between a closed position (FIG. 13) closing the toner supply opening 20 and an open position (FIG. 11) opening the toner supply opening 20. The spring 72 is configured to bias the first shutter 21 toward the closed position. Thus, the first shutter 21 is positioned at its closed position in the detached state of the toner cartridge 4 from the drum unit 5.

Specifically, the first shutter 21 is pivotally movable between the open position and the closed position. The first shutter 21 includes a shaft portion 21A and a body portion 21B. The shaft portion 21A extends in the axial direction and is rotatably supported to the hopper 57. The body portion 21B covers the toner supply opening 20 in the closed position of the first shutter 21. The body portion 21B is plate shaped and has one end portion fixed to the shaft portion 21A and the other end portion opposite to the one end portion. The body portion 21B is positioned along the wall 68 of the supply portion 58 in the closed position of the first shutter 21. The other end portion of the body portion 21B is bent in a direction away from the wall 68 in the closed position of the first shutter 21. The other end portion of the body portion 21B is in contact with the receiving portion 66 during attachment of the toner cartridge 4 to the drum unit 5.

As illustrated in FIG. 11, the first shutter 21 moves from the closed position to the open position by the abutment of the other end portion of the body portion 21B against the receiving portion 66 during attachment of the toner cartridge 4 to the drum unit 5. Thus, the first shutter 21 is positioned at its open position in the attached state of the toner cartridge 4 to the drum unit 5.

That is, the first developing shutter 41 is at the open position, and the first shutter 21 is at the open position in the attached state of the toner cartridge 4 to the drum unit 5. Therefore, the toner supply opening 20 is in communication with the inlet opening 16 in the attached state of the toner cartridge 4 to the drum unit 5. That is, the toner supply opening 20 is configured to communicate the inlet opening 16. Accordingly, toner in the toner cartridge 4 can be supplied to the developing unit 6 through the toner supply opening 20 and the inlet opening 16.

Further, the first seal 55 is positioned between the inlet opening 16 and the toner supply opening 20. That is, the image forming apparatus 1 includes the first seal 55.

The first seal 55 is configured to seal a boundary between the wall 68 of the supply portion 58 and the wall 27 of the receiving portion 66. The first seal 55 is resiliently deformable. The first seal 55 is adhered to the wall 68 of the supply portion 58 by an adhesive agent. The first seal 55 surrounds the toner supply opening 20.

Incidentally, as illustrated in FIG. 13, the first seal 55 seals the boundary between the wall 68 of the supply portion 58 and the first shutter 21 in the state where the first shutter 21 is at the closed position as a result of detachment of the toner cartridge 4 from the drum unit 5. The first seal 55 is positioned between the wall 68 and the body portion 21B in the closed position of the first shutter 21.

Further, as illustrated in FIGS. 11 and 12, the toner cartridge 4 is configured to collect toner discharged from the developing unit 6. The toner cartridge 4 has a toner reception opening 23. The toner reception opening 23 is an opening through which toner discharged from the second chamber 15 is introduced into the toner cartridge 4 in the attached state of the toner cartridge 4 and the process unit 3 to the main body 2. The toner reception opening 23 faces the discharge opening 22 in the vertical direction in the attached state of the toner cartridge 4 and the process unit 3 to the main body 2. The toner reception opening 23 has a dimension in the array direction greater than the dimension of the discharge opening 22 in the array direction.

Specifically, the toner cartridge 4 further includes a collecting portion 59. The collecting portion 59 is positioned below the discharge portion 67 in the attached state of the toner cartridge 4 and the process unit 3 to the main body 2. The collecting portion 59 includes a wall 69 formed with the toner reception opening 23.

The wall 69 is positioned at an upper portion of the collecting portion 59 in the attached state of the toner cartridge 4 and the process unit 3 to the main body 2. The wall 69 extends in the array direction. That is, the wall 69 extends in the sliding direction of the developing unit 6. The wall 69 of the collecting portion 59 faces the wall 29 of the discharge portion 67 in the vertical direction in the attached state of the toner cartridge 4 and the process unit 3 to the main body 2.

As illustrated in FIG. 13, the toner cartridge 4 further includes a second shutter 24, a spring 73, and a second seal 56.

The second shutter 24 is configured to open and close the toner reception opening 23, and is positioned at an upper portion of the collecting portion 59. The second shutter 24 is moveable between a closed position (FIG. 13) closing the toner reception opening 23 and an open position (FIG. 11) opening the toner reception opening 23. The spring 73 is configured to bias the second shutter 24 toward the closed position. Thus, the second shutter 24 is maintained at its closed position in the detached state of the toner cartridge 4 from the drum unit 5.

Specifically, the second shutter 24 is pivotally movable between the open position and the closed position. The second shutter 24 includes a shaft portion 24A and a body portion 24B. The shaft portion 24A extends in the axial direction and is rotatably supported to the hopper 57. The body portion 24B covers the toner reception opening 23 in the closed position of the second shutter 24. The body portion 24B is plate shaped and has one end portion fixed to the shaft portion 24A and the other end portion opposite to the one end portion. The body portion 24B is positioned along the wall 69 of the collecting portion 59 in the closed position of the second shutter 24. The other end portion of the body portion 24B is bent in a direction away from the wall 69 in the closed position of the second shutter 24. The other end portion of the body portion 24B is in contact with the discharge portion 67 during attachment of the toner cartridge 4 to the drum unit 5.

As illustrated in FIG. 11, the second shutter 24 moves from the closed position to the open position by the abutment of the other end portion of the body portion 24B against the discharge portion 67 during attachment of the toner cartridge 4 to the drum unit 5. Thus, the second shutter 24 is maintained at its open position in the attached state of the toner cartridge 4 to the drum unit 5.

That is, the second developing shutter 43 is at the open position, and the second shutter 24 is at the open position in the attached state of the toner cartridge 4 to the drum unit 5. Therefore, the discharge opening 22 is in communication with the toner reception opening 23 in the attached state of the toner cartridge 4 to the drum unit 5. That is, the toner reception opening 23 is configured to communicate the discharge opening 22. Accordingly, toner discharged through the discharge opening 22 from the developing unit 6 can be received into the toner cartridge 4 through the toner reception opening 23.

Further, the second seal 56 is positioned between the discharge opening 22 and the toner reception opening 23. That is, the image forming apparatus 1 includes the second seal 56. The second seal 56 is configured to seal a boundary between the wall 69 of the collecting portion 59 and the wall 29 of the discharge portion 67. The second seal 56 is resiliently deformable. The second seal 56 is adhered to the wall 69 of the collecting portion 59 by an adhesive agent. The second seal 56 surrounds the toner reception opening 23.

Incidentally, in FIG. 13, the second seal 56 seals the boundary between the wall 69 of the collecting portion 59 and the second shutter 24 in the state where the second shutter 24 is at the closed position as a result of detachment of the toner cartridge 4 from the drum unit 5. The second seal 56 is positioned between the wall 69 and the body portion 24B in the closed position of the second shutter 24.

4. Details of Drum Unit

Details of the drum unit 5 will next be described with reference to FIGS. 3, 4, and 10.

Figure 10:
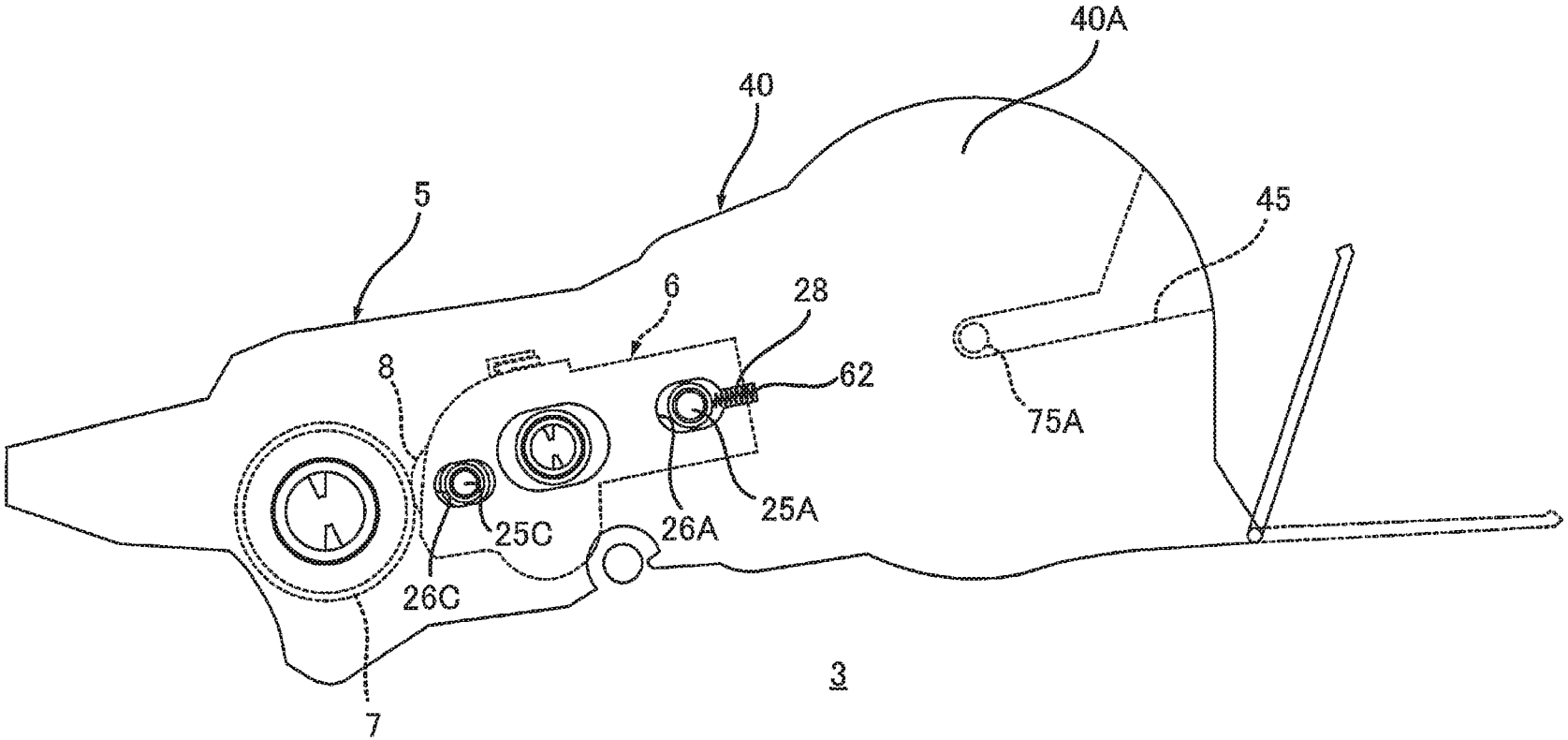
FIG. 10 is a side view of the process unit illustrated in FIG. 4.

As illustrated in FIGS. 3 and 10, the drum unit 5 movably supports the developing unit 6. Specifically, the drum unit 5 supports the developing unit 6 slidably in the array direction of the first chamber 14 and the second chamber 15 (FIG. 4). That is, the developing unit 6 is movable relative to the drum unit 5, and the toner cartridge 4 is attachable to and detachable from the drum unit 5.

The drum unit 5 further includes a drum frame 40 and an urging member 28. The drum frame 40 includes a first side wall 40A and a second side wall 40B spaced away from the first side wall 40A in the axial direction. The drum frame 40 rotatably supports the photosensitive drum 7. The first side wall 40A supports one end portion of the photosensitive drum 7 in the axial direction, and the second side wall 40B supports the other end portion of the photosensitive drum 7 in the axial direction.

The drum frame 40 has a first slot 26A, a second slot 26B, a third slot 26C, and a fourth slot 26D. In other words, the drum unit 5 has the first slot 26A, the second slot 26B, the third slot 26C, and the fourth slot 26D. The first slot 26A, the second slot 26B, the third slot 26C, and the fourth slot 26D are configured to allow the developing unit 6 to slide relative to the drum unit 5.

The first side wall 40A has the first and third slots 26A and 26C. The first and third slots 26A and 26C are spaced from each other in the array direction. A protruding portion 25A is inserted through the first slot 26A. The first slot 26A has a dimension in the array direction greater than the dimension of the first slot 26A in the vertical direction. Further, the dimension of the first slot 26A in the array direction is greater than an outer diameter of the protruding portion 25A.

The developing unit 6 includes the protruding portion 25A. The protruding portion 25A is positioned at one of the outer surfaces of the second chamber 15 in the axial direction. Specifically, the protruding portion 25A is positioned at the one of the outer surfaces of the first side wall 65A of the chamber body 65. The protruding portion 25A protrudes from the first side wall 65A. The protruding portion 25A is cylindrical in shape. The protruding portion 25A is the one end portion 11A of the shaft 11. The one end portion 11A of the shaft 11 extends through the first side wall 65A and protrudes outward of the second chamber 15.

A protruding portion 25C is inserted through the third slot 26C. The third slot 26C has a dimension in the array direction greater than the dimension of the third slot 26C in the vertical direction. Further, the dimension of the third slot 26C in the array direction is greater than an outer diameter of the protruding portion 25C.

The developing unit 6 includes the protruding portion 25C. The protruding portion 25C is positioned at one of the outer surfaces of the first chamber 14 in the axial direction. Specifically, the protruding portion 25C is positioned at the one of the outer surfaces of the first side wall 14A of the first chamber 14. The protruding portion 25C protrudes from the first side wall 14A. The protruding portion 25C is cylindrical in shape. The protruding portion 25C is one end portion 13A of the developing roller shaft 13. The one end portion 13A extends through the first side wall 14A and protrudes outward of the first chamber 14.

The second side wall 40B has the second and fourth slots 26B and 26D. The second and fourth slots 26B and 26D are spaced from each other in the array direction. A protruding portion 25B is inserted through the second slot 26B (FIG. 3). The second slot 26B has a dimension in the array direction greater than the dimension of the second slot 26B in the vertical direction. Further, the dimension of the second slot 26B in the array direction is greater than an outer diameter of the protruding portion 25B.

The developing unit 6 includes the protruding portion 25B. The protruding portion 25B is positioned at the other outer surface of the second chamber 15 in the axial direction. Specifically, the protruding portion 25B is positioned at one of the outer surfaces of the second side wall 65B of the chamber body 65. The protruding portion 25B protrudes from the second side wall 65B. The protruding portion 25B is cylindrical in shape. The protruding portion 25B is the other end portion 11B of the shaft 11. The other end portion 11B of the shaft 11 extends through the second side wall 65B and protrudes outward of the second chamber 15.

A protruding portion 25D is inserted through the fourth slot 26D. The fourth slot 26D has a dimension in the array direction greater than the dimension of the fourth slot 26D in the vertical direction. Further, the dimension of the fourth slot 26D in the array direction is greater than an outer diameter of the protruding portion 25D.

The developing unit 6 includes the protruding portion 25D. The protruding portion 25D is positioned at the other outer surface of the first chamber 14 in the axial direction. Specifically, the protruding portion 25D is positioned at the one of the outer surfaces of the second side wall 14B of the first chamber 14. The protruding portion 25D protrudes from the second side wall 14B. The protruding portion 25D is cylindrical in shape. The protruding portion 25D is the other end portion 13B of the developing roller shaft 13. The other end portion 13B extends through the second side wall 14B and protrudes outward of the first chamber 14.

Further, as illustrated in FIG. 10, the drum frame 40 includes a groove 62. Specifically, the first side wall 40A has the groove 62. The groove 62 is positioned opposite to the photosensitive drum 7 with respect to the first slot 26A. The groove 62 is recessed from an inner surface of the first slot 26A in a direction away from the photosensitive drum 7.

The urging member 28 is accommodated in the groove 62. The urging member 28 urges the protruding portion 25A inserted through the first slot 26A toward the photosensitive drum 7. Thus, the urging member 28 urges the developing unit 6 toward the photosensitive drum 7. That is, the urging member 28 urges the developing roller 8 toward the photosensitive drum 7.

Incidentally, the second side wall 40B has a groove (not illustrated) similar to the groove 62 of the first side wall 40A. The groove is recessed from an inner surface of the second slot 26B in a direction away from the photosensitive drum 7. An urging member (not illustrated) is accommodated in the groove of the second side wall 40B. The urging member urges the protruding portion 25B inserted through the second slot 26B toward the photosensitive drum 7. Thus, the developing roller 8 is urged toward the photosensitive drum 7 uniformly in the axial direction.

With the structure, the developing roller 8 is movable relative to the photosensitive drum 7 since the developing unit 6 is movable relative to the drum unit 5. Further, the urging member 28 urges the developing roller 8 toward the photosensitive drum 7.

Therefore, the developing roller 8 can follow the photosensitive drum 7 even if the photosensitive drum 7 is eccentrically rotated. Thus, the developing roller 8 can be in contact with the photosensitive drum 7 with a constant pressure.

As illustrated in FIG. 11, the drum frame 40 is configured to allow the toner cartridge 4 to be attached to and detached from the drum frame 40. As illustrated in FIG. 3, the drum frame 40 has a first groove 45 and a second groove 46. These grooves 45, 46 guide attachment and detachment of the toner cartridge 4 to and from the drum unit 5. The first groove 45 is formed at the first side wall 40A. The first groove 45 is positioned at the other surface of the first side wall 40A in the axial direction. The first groove 45 is positioned opposite to the photosensitive drum 7 with respect to the developing unit 6 in the array direction. As illustrated in FIG. 10, the first groove 45 has a first end portion and a second end portion in the array direction. The first end portion is closer to the developing unit 6 than the second end portion is to the developing unit 6. The second end portion is an open end opening to the array direction.

The one end portion 75A of the agitator shaft 75 is inserted in the first groove 45 in the attached state of the toner cartridge 4 to the drum unit 5. Incidentally, the one end portion 75A of the agitator shaft 75 extends through the first side wall 57A and protrudes outward of the hopper 57 (FIG. 12). The first end portion of the first groove 45 has a dimension in the vertical direction approximately equal to a dimension of the one end portion 75A of the agitator shaft 75 in the vertical direction.

As illustrated in FIG. 4, the second groove 46 is provided at the second side wall 40B. The second groove 46 is positioned at one surface of the second side wall 40B in the axial direction. The second groove 46 is positioned opposite to the photosensitive drum 7 with respect to the developing unit 6 in the array direction. The second groove 46 has a first end portion and a second end portion in the array direction. The first end portion is closer to the developing unit 6 than the second end portion is to the developing unit 6. The second end portion is an open end opening to the array direction.

The other end portion 75B of the agitator shaft 75 is inserted in the second groove 46 in the attached state of the toner cartridge 4 to the drum unit 5. Incidentally, the other end portion 75B of the agitator shaft 75 extends through the second side wall 57B and protrudes outward of the hopper 57 (FIG. 12). The first end portion of the second groove 46 has a dimension in the vertical direction approximately equal to a dimension of the other end portion 75B of the agitator shaft 75 in the vertical direction. Thus, movement of the toner cartridge 4 in the vertical direction is restricted in the attached state of the toner cartridge 4 and the process unit 3 to the main body 2.

As illustrated in FIG. 4, the drum frame 40 includes a contact portion 47. The contact portion 47 is provided in the first end portion of the second groove 46. The contact portion 47 is protrudable into and retractable from the second groove 46. The contact portion 47 is configured to prevent the other end portion 75B of the agitator shaft 75 from moving in the array direction after the other end portion 75B of the agitator shaft 75 reaches the first end portion of the second groove 46 in the attached state of the toner cartridge 4 to the drum unit 5.

The contact portion 47 is positioned opposite to the photosensitive drum 7 with respect to the other end portion 75B in the attached state of the toner cartridge 4 to the drum unit 5. The other end portion 75B will be abutted against the contact portion 47 when the toner cartridge 4 is moved in a direction away from the photosensitive drum 7.

Thus, movement of the toner cartridge 4 in the array direction is restricted by the contact portion 47 in the attached state of the toner cartridge 4 and the process unit 3 to the main body 2. That is, the position of the toner cartridge 4 is fixed relative to the drum unit 5 in the attached state of the toner cartridge 4 to the drum unit 5. Therefore, the relative position of the toner cartridge 4 with respect to the photosensitive drum 7 is maintained in the attached state of the toner cartridge 4 and the process unit 3 to the main body 2.

Incidentally, the contact portion 47 will be retracted downward to allow the other end portion 75B to pass through the contact portion 47, when the toner cartridge 4 is moved in the direction away from the photosensitive drum 7 in the contacting state of the other end portion 75B with the contact portion 47. Therefore, the contact portion 47 allows the toner cartridge 4 from being detached from the drum unit 5.

5. Function and Effect

As illustrated in FIG. 4, the frame 10 includes the first chamber 14 accommodating therein the developing roller 8, the second chamber 15 accommodating therein the toner supply member 9, the inlet opening 16, and the adjustment member 17 positioned between the first chamber 14 and the second chamber 15.

The inlet opening 16 is the opening through which toner in the toner cartridge 4 is introduced into the second chamber 15 in the attached state of the toner cartridge 4 and the process unit 3 to the main body 2. Therefore, the toner from the toner cartridge 4 is initially accommodated in the second chamber 15.

Then, as illustrated in FIG. 9, the adjustment member 17 allows the toner T to pass therethrough from the second chamber 15 to the first chamber 14 in the situation where the toner level in the first chamber 14 is lower than the predetermined level and the flexible sheet 12 is moved in the rotational direction R from the lower edge 17B toward the upper edge 17A of the adjustment member 17.

In this case, a predetermined amount of toner passes through the adjustment member 17 and moves to the first chamber 14.

Figure 15:
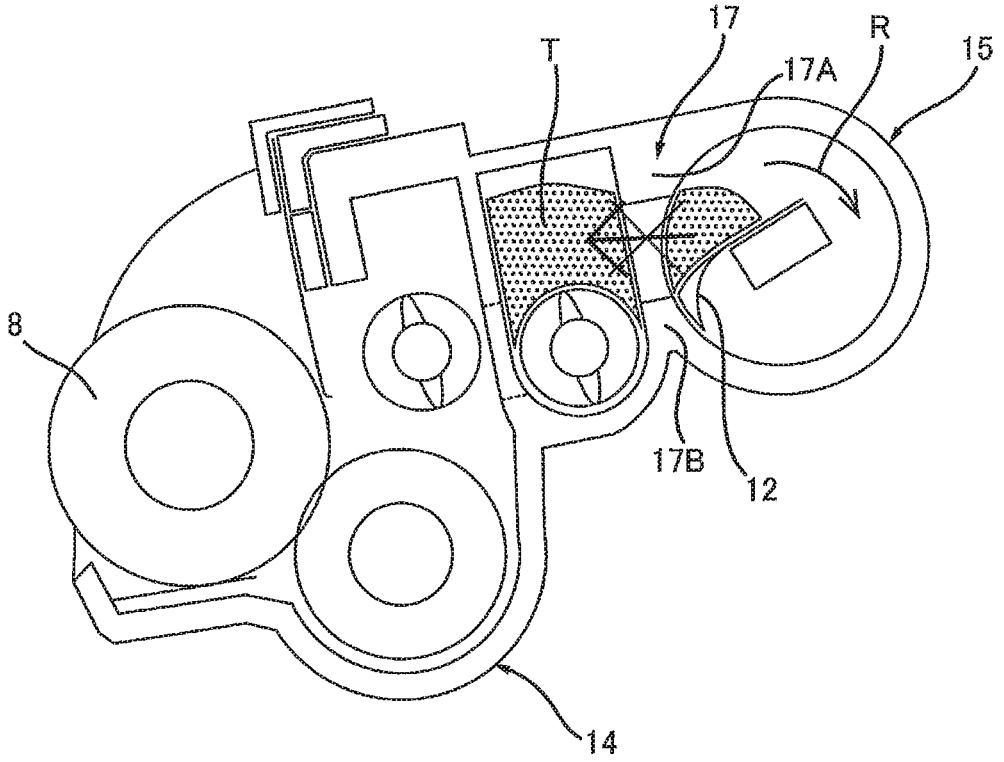
FIG. 15 is a view for description of a situation where the toner does not move from the second chamber illustrated in FIG. 9 to the first chamber.

On the other hand, as illustrated in FIG. 15, the adjustment member 17 prevents the toner T from passing therethrough from the second chamber 15 to the first chamber 14 in the situation where the toner level in the first chamber 14 is higher than the predetermined level even though the flexible sheet 12 is moved in the rotational direction R from the lower edge 17B toward the upper edge 17A of the adjustment member 17. Further, as illustrated in FIG. 14, the adjustment member 17 prevents the toner in the first chamber 14 from returning therethrough to the second chamber 15.

Because a predetermined amount of toner can be moved from the second chamber 15 to the first chamber through the adjustment member 17 when the level of the toner T in the first chamber 14 is lower than the predetermined level, the toner level in the first chamber 14 can be adjusted.

That is, as illustrated in FIG. 9, the level of the toner T in the first chamber r14 can be set within a predetermined range without any employment of a sensor. Thus, the image forming apparatus 1 is not provided with the sensor.

Further, as illustrated in FIG. 10, the developing unit 6 is movable relative to the drum unit 5. Further, as illustrated in FIG. 11, the position of the toner cartridge 4 relative to the photosensitive drum 7 can be maintained in the attached state of the toner cartridge 4 and the process unit 3 to the main body 2.

Therefore, the developing unit 6 and the toner cartridge 4 are relatively moved when the developing unit 6 is moved relative to the drum unit 5. In such a structure, toner may not pass through the adjustment member 17 but may be leaked, if the adjustment member 17 were positioned between the developing unit 6 and the toner cartridge 4, and if the developing unit 6 and the toner cartridge 4 are relatively moved.

On the other hand, in the image forming apparatus 1 according to the above-described embodiment, the adjustment member 17 is positioned between the first chamber 14 and the second chamber 15, and no relative movement occur between the first chamber 14 and the second chamber 15 even if the developing unit 6 and the toner cartridge 4 are relatively moved. Accordingly, toner can stably pass through the adjustment member 17 avoiding toner leakage.

6. Modifications

Various modifications will be described with reference to FIGS. 16 through 23. The modifications provide function and effect similar to those of the above-described embodiment.

6.1 First Modification

Figure 16:
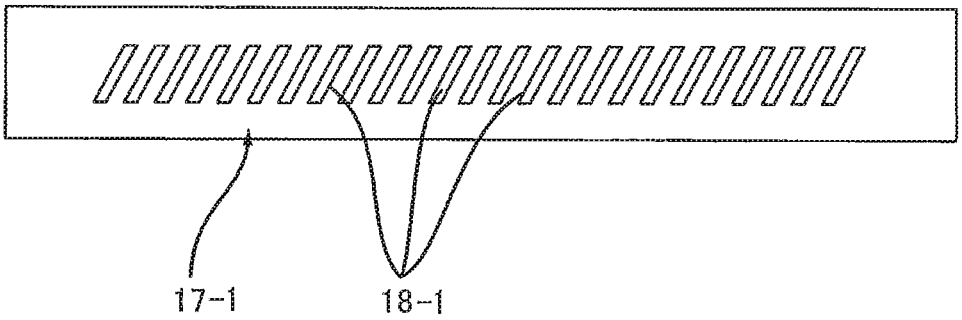
FIG. 16 is a view illustrating an adjustment member in an image forming apparatus according to a first modification.

Configuration of the slit 18 is not limited to that of the above-described embodiment. As illustrated in FIG. 16, in an adjustment member 17-1, slits 18-1 are slanted with respect to the vertical direction in the attached state of the process unit 3 to the main body 2.

6.2 Second Modification

Figure 17:
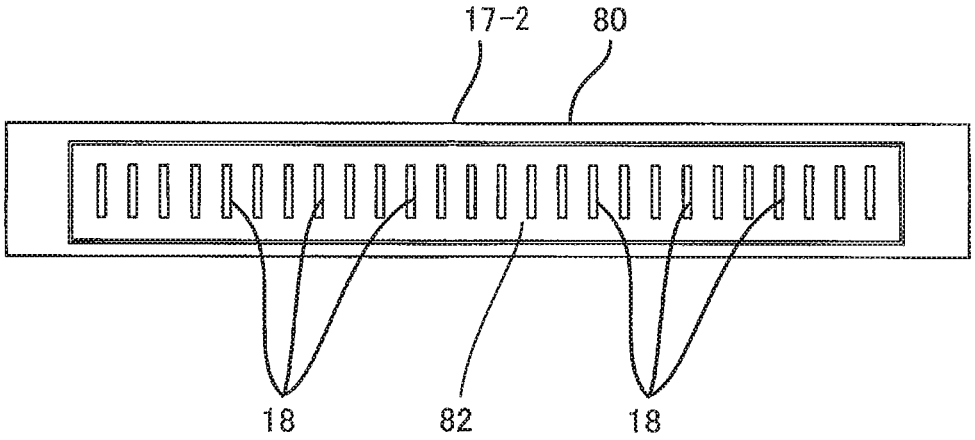
FIG. 17 is a view illustrating an adjustment member in an image forming apparatus according to a second modification.
Figure 18:
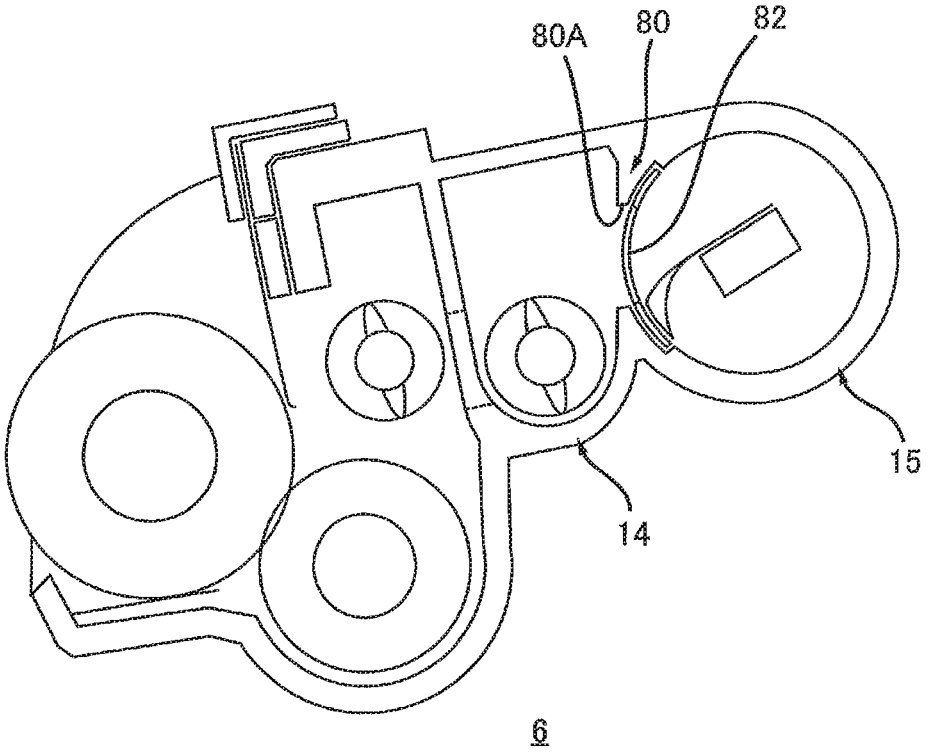
FIG. 18 is a cross-sectional view of a developing unit provided with the adjustment member illustrated in FIG. 17.

Construction of the adjustment member 17 is not limited to that of the above-described embodiment. As illustrated in FIGS. 17 and 18, an adjustment member 17-2 includes a rim 80 and an attachment member 82. The rim 80 is integral with the frame 10. The rim 80 has an opening 80A allowing communication between the first chamber 14 and the second chamber 15. The attachment member 82 is a component independent of the frame 10. The attachment member 82 has a plurality of slits 18. The attachment member 82 is attached to the rim 80 so as to cover the opening 80A in its entirety. The attachment member 82 is adhered to the rim 80 by an adhesive agent.

6.3 Third Modification

Figure 19:
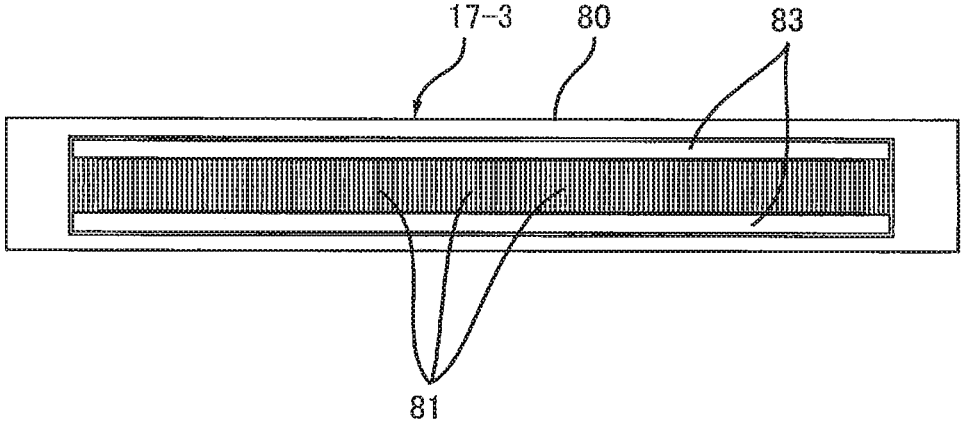
FIG. 19 is a view illustrating an adjustment member in an image forming apparatus according to a third modification.
Figure 20:
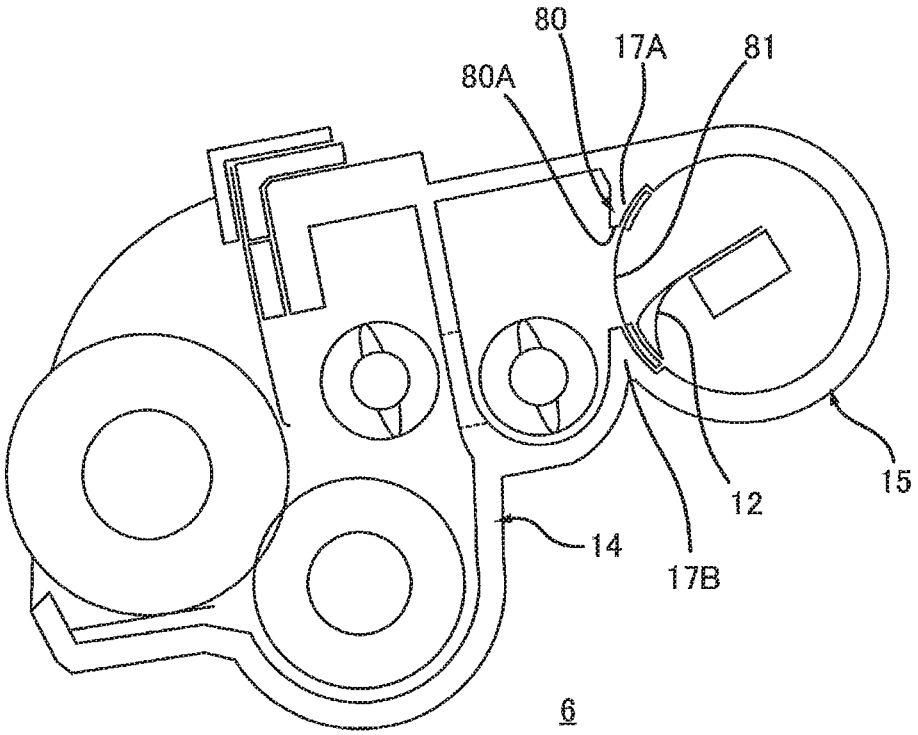
FIG. 20 is a cross-sectional view of a developing unit provided with the adjustment member illustrated in FIG. 19.

As illustrated in FIGS. 19 and 20, an adjustment member 17-3 includes a rim 80 and a plurality of fibers 81. The plurality of fibers 81 extend in the vertical direction traversing the rim 80. Specifically, the plurality of fibers 81 extend in the vertical direction traversing the opening 80A. The plurality of fibers 81 are arrayed side by side in the axial direction. Neighboring fibers may be in contact with each other, or may be spaced away from each other. The plurality of fibers 81 are attached to the rim 80 so as to cover the opening 80A in its entirety. The plurality of fibers 81 are adhered to the rim 80 by an adhesive tape 83.

According to the third modification, toner is moved to the first chamber 14 through the gaps between the neighboring fibers 81 as a result of pushing the toner in the second chamber 15 toward the plurality of fibers 81 by the flexible sheet 12 as a result of movement of the flexible sheet 12 from the lower edge 17B toward the upper edge 17A of the adjustment member 17. That is, the adjustment member 17-3 allows the toner to move from the second chamber 15 to the first chamber 14.

6.4 Fourth Modification

Figure 21:
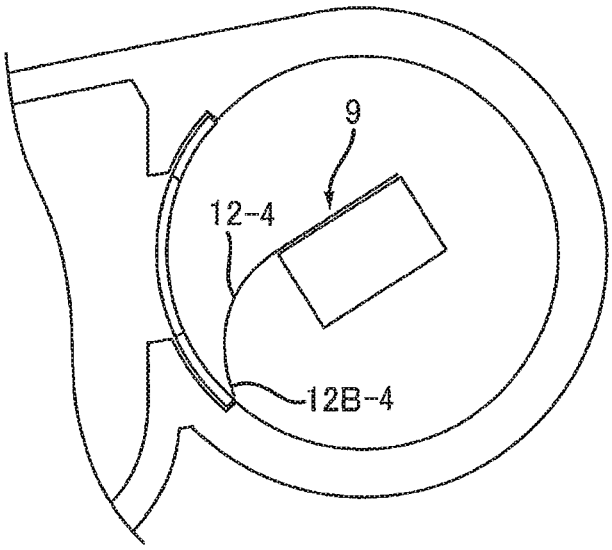
FIG. 21 is a view of a developing cartridge in an image forming apparatus according to a fourth modification.

Configuration of the flexible sheet 12 is not limited to that of the above-described embodiment. For example, as illustrated in FIG. 21, a free end portion 12B-4 of a flexible sheet 12-4 is not inclined, but extends in the axial direction.

6.5 Fifth Modification

Figure 22:
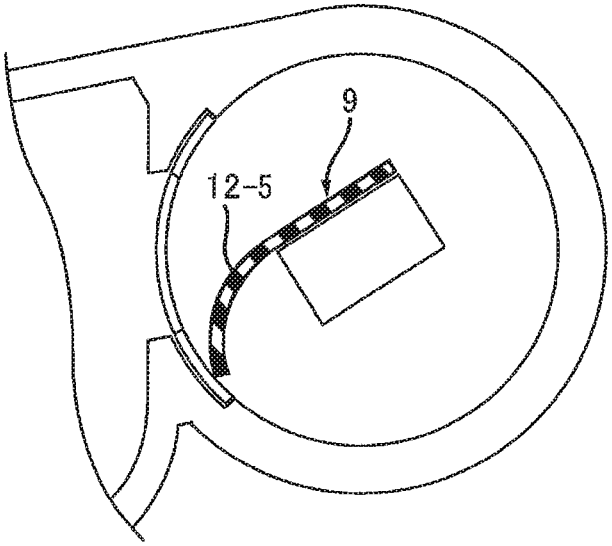
FIG. 22 is a view of a developing cartridge in an image forming apparatus according to a fifth modification.
Figure 23:
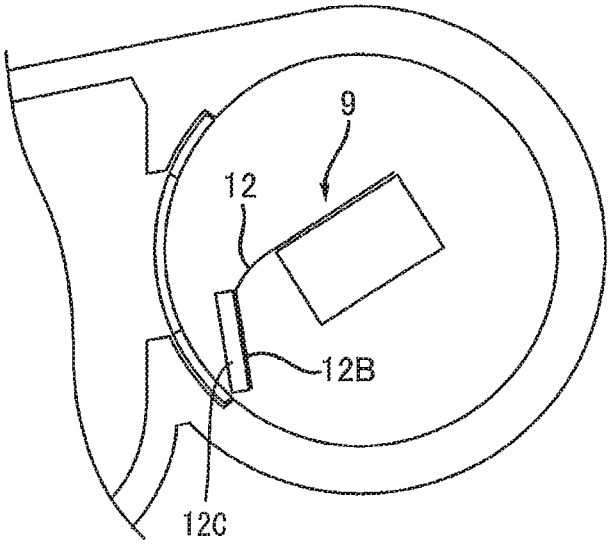
FIG. 23 is a view of a developing cartridge in an image forming apparatus according to a sixth modification.

Further, a material of the flexible sheet 12 is not limited to a flexible film as long as flexibility is provided in the sheet. For example, as illustrated in FIG. 22, a flexible sheet 12-5 is made from rubber.

6.6 Sixth Modification

The sixth modification includes a plate member 12C provided at the free end portion 12B of the flexible sheet 12.

6.7 Seventh Modification

A structure of the toner cartridge 4 is not limited to that of the above-described embodiment. For example, a toner cartridge may not be attachable to or detachable from the drum unit 5, but may be directly attachable to or detachable from the main body 2.

6.8 Eighth Modification

A structure of the developing unit 6 is not limited to that of the above-described embodiment. For example, a developing unit 6 may be movable relative to the drum unit 5 such that the developing roller 8 is movable between a first position and a second position positioned farther from the center of the photosensitive drum 7 than the first position is from the center of the photosensitive drum 7. The developing roller 8 is in contact with the photosensitive drum 7 at the first position, and the developing roller 8 is separated from the photosensitive drum 7 at the second position.

6.9 Ninth Modification

The position of the first seal 55 is not limited to that of the above-described embodiment. For example, the first seal 55 may be provided at the developing unit 6, or may be provided at the receiving portion 66.

6.10 Tenth Modification

The position of the second seal 56 is not limited to that of the above-described embodiment. For example, the second seal 56 may be provided at the developing unit 6 or may be provided at the discharge portion 67.

While the description has been made in detail with reference to the embodiments thereof, it would be apparent to those skilled in the art that many modifications and variations may be made therein without departing from the spirit of the disclosure.

What is claimed is:

1. A process unit for use with an image forming apparatus, comprising:

a drum unit comprising a photosensitive drum; and a developing unit being movable relative to the drum unit, the developing unit comprising:

a frame comprising:

an upper wall;

a bottom wall;

a first chamber;

a second chamber having an inlet opening through which toner is introduced to the second chamber, the second chamber and the first chamber being arrayed in a horizontal direction in a state where the process unit is attached to the image forming apparatus;

an adjustment member positioned between the first chamber and the second chamber;

a developing roller disposed in the first chamber; and a toner supply member disposed in the second chamber, the toner supply member comprising:

a shaft rotatably supported by the frame, and a flexible sheet disposed on the shaft, the flexible sheet being configured to move while being in contact with the adjustment member when the shaft is rotating, wherein the adjustment member has a slit, the slit of the adjustment member having a width ranging from 0.5 mm to 5.0 mm for allowing the toner to pass therethrough from the second chamber to the first chamber and for preventing the toner to pass therethrough from the first chamber to the second chamber, and wherein the adjustment member further has an upper edge connected to the upper wall and a lower edge connected to the bottom wall.

2. The process unit according to claim 1, wherein the developing roller is rotatable about a rotation axis defining an axial direction, and the adjustment member has a plurality of slits arrayed in the axial direction.

3. The process unit according to claim 2, wherein the slit has a length in a vertical direction greater than a width in the axial direction.

4. The process unit according to claim 3, wherein the flexible sheet is made of a flexible film.

5. The process unit according to claim 1, wherein the flexible sheet is made from rubber.

6. The process unit according to claim 1, wherein the inlet opening is positioned above the toner supply member in a state where the process unit is attached to the image forming apparatus.

7. The process unit according to claim 1, wherein the developing unit includes a protruding portion, and the drum unit has a wall having a slot allowing the protruding portion to be inserted therethrough, the slot allowing the developing unit to move with respect to the drum unit in a sliding direction.

8. The process unit according to claim 1, wherein the drum unit comprises an urging member configured to urge the developing roller to the photosensitive drum.

9. The process unit according to claim 1, further comprising a toner cartridge configured to be attached to and detached from the drum unit, the toner cartridge being configured to accommodate toner therein.

10. The process unit according to claim 9, further comprising a first seal that is resiliently deformable, wherein the toner cartridge has a toner supply opening configured to communicate with the inlet opening, and wherein the first seal is positioned between the inlet opening and the toner supply opening.

11. The process unit according to claim 10, wherein the toner cartridge comprises a first shutter that opens and closes the toner supply opening.

12. The process unit according to claim 9, wherein the frame has a discharge opening through which the toner is discharged from the second chamber to the toner cartridge in a state where the toner cartridge is attached to the process unit.

13. The process unit according to claim 12, wherein the discharge opening is positioned below the toner supply member in a state where the process unit is attached to the image forming apparatus.

14. The process unit according to claim 12, further comprising a second seal that is resiliently deformable, wherein the toner cartridge has a toner reception opening configured to communicate with the discharge opening, and wherein the second seal is positioned between the discharge opening and the toner reception opening.

15. The process unit according to claim 14, wherein the toner cartridge comprises a second shutter that opens and closes the toner reception opening.

* * * * *